US011944192B2

(12) United States Patent
Merten

(10) Patent No.: US 11,944,192 B2
(45) Date of Patent: Apr. 2, 2024

(54) MODULAR FURNITURE SYSTEM

(71) Applicant: MertenWu Pty Ltd, Narrabri (AU)

(72) Inventor: Errol Alasdair Merten, Narrabri (AU)

(73) Assignee: Mertenwu Pty Ltd, Narrabri (AU)

( * ) Notice: Subject to any disclaimer, the term of this patent is extended or adjusted under 35 U.S.C. 154(b) by 194 days.

(21) Appl. No.: 17/345,483

(22) Filed: Jun. 11, 2021

(65) Prior Publication Data

US 2021/0386197 A1 Dec. 16, 2021

(30) Foreign Application Priority Data

Jun. 15, 2020 (AU) ..... 2020901968

(51) Int. Cl.

| | |
|---|---|
| ***A47B 47/04*** | (2006.01) |
| ***A47B 47/00*** | (2006.01) |
| ***A47B 87/02*** | (2006.01) |

(52) U.S. Cl.

CPC ..... *A47B 47/042* (2013.01); *A47B 47/0075* (2013.01); *A47B 47/047* (2013.01); *A47B 87/0276* (2013.01)

(58) Field of Classification Search

CPC ..... A47B 47/0025; A47B 47/0033; A47B 47/0041; A47B 47/005; A47B 47/042; A47B 47/047; A47B 47/0075; A47B 87/0276

See application file for complete search history.

(56) References Cited

U.S. PATENT DOCUMENTS

| | | | | |
|---|---|---|---|---|
| 4,470,647 | A * | 9/1984 | Bishoff | A47B 47/0041 312/236 |
| 4,515,280 | A * | 5/1985 | Sheu | A47B 47/0033 211/186 |
| 5,039,177 | A | 8/1991 | Newell et al. | |
| 5,466,057 | A * | 11/1995 | Blankenburg | A47B 87/005 312/111 |
| 2006/0207957 | A1* | 9/2006 | Chen | A47B 47/0066 211/183 |
| 2009/0166356 | A1* | 7/2009 | Tsai | A47F 3/12 220/4.01 |

(Continued)

FOREIGN PATENT DOCUMENTS

| | | |
|---|---|---|
| CN | 202287030 | 7/2012 |
| CN | 202407858 | 9/2012 |
| CN | 205154824 | 4/2016 |

(Continued)

OTHER PUBLICATIONS

Search Report from corresponding European Patent Application 21 178 396.4 dated Nov. 2, 2021 (5 pages).

(Continued)

*Primary Examiner* — Matthew W Ing
(74) *Attorney, Agent, or Firm* — Anderson Gorecki LLP

(57) ABSTRACT

A wall connector for a modular furniture system is provided. The wall connector comprises a rail extending between a first end portion and a second end portion. The rail defines a first channel configured to fittingly receive an edge portion of a first side wall and a second channel configured to fittingly receive an edge portion of a second side wall such that the second side wall is orthogonal to the first side wall. Each of the first and second end portions is configured to engage a corner portion of an end wall for attachment thereto.

19 Claims, 27 Drawing Sheets

(56) References Cited

U.S. PATENT DOCUMENTS

2016/0138627 A1 5/2016 Bellido Jose

FOREIGN PATENT DOCUMENTS

| | | | | |
|---|---|---|---|---|
| CN | 206651546 | | | 11/2017 |
| DE | 20004570 | | | 5/2000 |
| KR | 20190130256 | | | 11/2018 |
| KR | 20190037627 | A | * | 4/2019 |
| KR | 102045274 | | | 11/2019 |

OTHER PUBLICATIONS

Search Report from corresponding Chinese Patent Application 202010808442.4 dated Apr. 2022 (7 pages).

* cited by examiner

MODULAR FURNITURE SYSTEM

TECHNICAL FIELD

The present disclosure relates to a modular furniture system. The present disclosure also relates to a wall connector for a modular furniture system.

BACKGROUND

It is known for furniture to be prefabricated in components that can be sold disassembled in a flat-pack and then assembled on site. Assembly of such flat-pack furniture typically requires additional hardware, tooling, and detailed instructions. Some furniture manufacturers have attempted to minimise the tooling and hardware requirements necessary to assemble furniture. However, the furniture may still require skilled corrections, may not be aesthetically or functionally pleasing, or may be weighty.

Flat-pack furniture in the form of cube storage units are known and are typically sold in fixed configurations, such as, for example, two, four, six, eight-cube options. In some instances, users may combine such cube storage units by stacking one cube storage unit unsecurely on top of another cube storage unit to increase storage capacities. However, stacking an unsecured cube storage unit on top of another cube storage unit could lead to one or all of the cube storage units falling over causing harm to bystanders.

OBJECT

It is an object of the present disclosure to substantially overcome or ameliorate one or more of the above disadvantages.

SUMMARY

There is disclosed herein a wall connector for a modular furniture system, the wall connector comprising:

- a rail extending between a first end portion and a second end portion, the rail defining a first channel configured to fittingly receive an edge portion of a first side wall and a second channel configured to fittingly receive an edge portion of a second side wall such that the second side wall is orthogonal to the first side wall,
- wherein each of the first and second end portions is configured to engage a corner portion of an end wall for attachment thereto.

Each of the first and second end portions may comprise a ridge locating surface for abutment with a corner end surface of the corner portion. The ridge locating surface may have a recess to receive a tab extending from the corner end surface to form a snap lock connection therewith.

Each of the first and second end portions may comprise a planar locating surface for abutment with an interior surface of the corner portion, and a planar end surface with a first aperture therein for receiving a connecting pin portion of an end cap to form a bayonet connection therewith.

Each of the planar end surfaces may further comprise a second aperture for receiving a locking pin portion of the end cap to form a snap lock connection therewith.

Each of the first and second end portions further may comprise a protrusion extending from the planar locating surface. The protrusion may be configured to be fittingly received in a recess on the interior surface of the corner portion.

There is also disclosed herein a modular furniture system, comprising:

- a plurality of side walls, each of the side walls having opposed edge portions;
- a plurality of end walls, each of the end walls having four corner portions;
- a plurality of end caps; and
- a plurality of wall connectors, each of the wall connectors according to any one of that described above,
- wherein each of the opposed edge portions of the side walls is received within one of the channels of the wall connectors,
- wherein each of the corner portions of the end walls is engaged with one of the end portions of the wall connectors, and
- wherein each of the end caps is engaged with at least one of the end portions of the wall connectors to form one or more modular furniture units defining respective internal chambers.

At least one of the end caps may comprise a head portion and a connecting pin portion extending from the head portion. The connecting pin portion may be received in an aperture of a respective end portion to form a bayonet connection therewith.

The at least one of the end caps may further comprise a locking pin portion extending from the head portion. The locking pin portion may be received in a further aperture of the respective end portion to form a snap lock connection therewith.

In some embodiments, at least one of the end caps may engage a respective end portion of one of the wall connectors of a first of the modular furniture units, and a respective end portion of one of the wall connectors of a second of the modular furniture units. In one embodiment, at least one of the end caps may comprise a head portion and two connecting pin portions extending from the head portion. A first of the connecting pin portions may be received in an aperture of the respective end portion of one of the wall connectors of the first of the modular furniture units to form a bayonet connection therewith, and a second of the connecting pin portions may be received in an aperture of the respective end portion of one of the wall connectors of the second of the modular furniture units to form a bayonet connection therewith such that the first of the modular furniture units is connected to the second of the modular furniture units.

The at least one of the end caps may further comprise two locking pin portions extending from the head portion. A first of the locking pin portions may be received in a further aperture of the respective end portion of one of the wall connectors of the first of the modular furniture units to form a snap lock connection therewith, and a second of the locking pin portions may be received in a further aperture of the respective end portion of one of the wall connectors of the second of the modular furniture units to form a snap lock connection therewith.

In some embodiments, at least one of the end caps may engage a respective end portion of one of the wall connectors of a first of the modular furniture units, a respective end portion of one of the wall connectors of a second of the modular furniture units, and a respective end portion of one of the wall connectors of a third of the modular furniture units. In one embodiment, at least one of the end caps may comprise a head portion and three connecting pin portions extending from the head portion. A first of the connecting pin portions may be received in an aperture of the respective end portion of one of the wall connectors of the first of the modular furniture units to form a bayonet connection therewith, a second of the connecting pin portions may be received in an aperture of the respective end portion of one of the wall connectors of the second of the modular furniture units to form a bayonet connection therewith, and a third of the connecting pin portions may be received in an aperture of the respective end portion of one of the wall connectors of the third of the modular furniture units to form a bayonet connection therewith such that the first, second and third of the modular furniture units are connected together.

The at least one of the end caps may further comprise three locking pin portions extending from the head portion. A first of the locking pin portions may be received in a further aperture of the respective end portion of one of the wall connectors of the first of the modular furniture units to form a snap lock connection therewith, a second of the locking pin portions may be received in a further aperture of the respective end portion of one of the wall connectors of the second of the modular furniture units to form a snap lock connection therewith, and a third of the locking pin portions may be received in a further aperture of the respective end portion of one of the wall connectors of the third of the modular furniture units to form a snap lock connection therewith.

In some embodiments, at least one of the end caps may engage a respective end portion of one of the wall connectors of a first of the modular furniture units, a respective end portion of one of the wall connectors of a second of the modular furniture units, a respective end portion of one of the wall connectors of a third of the modular furniture units, and a respective end portion of one of the wall connectors of a fourth of the modular furniture units. In one embodiment, at least one of the end caps may comprise a head portion and four connecting pin portions extending from the head portion. A first of the connecting pin portions may be received in an aperture of the respective end portion of one of the wall connectors of the first of the modular furniture units to form a bayonet connection therewith, a second of the connecting pin portions may be received in an aperture of the respective end portion of one of the wall connectors of the second of the modular furniture units to form a bayonet connection therewith, a third of the connecting pin portions may be received in an aperture of the respective end portion of one of the wall connectors of the third of the modular furniture units to form a bayonet connection therewith, and a fourth of the connecting pin portions may be received in an aperture of the respective end portion of one of the wall connectors of the fourth of the modular furniture units to form a bayonet connection therewith such that the first, second, third and fourth of the modular furniture units are connected together.

The at least one of the end caps may further comprise four locking pin portions extending from the head portion. A first of the locking pin portions may be received in a further aperture of the respective end portion of one of the wall connectors of the first of the modular furniture units to form a snap lock connection therewith, a second of the locking pin portions may be received in a further aperture of the respective end portion of one of the wall connectors of the second of the modular furniture units to form a snap lock connection therewith, a third of the locking pin portions may be received in a further aperture of the respective end portion of one of the wall connectors of the third of the modular furniture units to form a snap lock connection therewith, and a fourth of the locking pin portions may be received in a further aperture of the respective end portion of one of the wall connectors of the fourth of the modular furniture units to form a snap lock connection therewith.

The modular furniture system may further comprise a plurality of fasteners. At least one of the end caps may comprise an aperture, and wherein one of the fasteners may be received in the aperture of said at least one of the end caps and in an aperture of a respective end portion.

Each of the modular furniture units may define a box with an internal chamber.

At least one of the end walls may comprise a frame defining the corner portions and a door hingedly connected to the frame.

In an aspect, there is provided a wall connector for a modular furniture system, the wall connector comprising:

a rail extending between a first end portion and a second end portion, the rail defining a first channel configured to fittingly receive an edge portion of a first side wall and a second channel configured to fittingly receive an edge portion of a second side wall such that the second side wall is orthogonal to the first side wall, wherein each of the first and second end portions is configured to locate a corner portion of an end wall and engage with an end cap to substantially secure the corner portion thereto.

In another aspect, there is provided a modular furniture system, comprising:

a plurality of side walls, each of the side walls having opposed edge portions;

a plurality of end walls, each of the end walls having four corner portions;

a plurality of end caps; and a plurality of wall connectors, each of the wall connectors according to any one of that described above, wherein each of the opposed edge portions of the side walls is received within one of the channels of the wall connectors, wherein each of the corner portions of the end walls is located at one of the end portions of the wall connectors, and wherein each of the end caps is engaged with at least one of the end portions of the wall connectors to secure the corner portions to the end portions to form one or more modular furniture units.

BRIEF DESCRIPTION OF DRAWINGS

Embodiments of the present disclosure will now be described hereinafter, by way of examples only, with reference to the accompanying drawings, in which.

DESCRIPTION OF EMBODIMENTS

Figure 1:
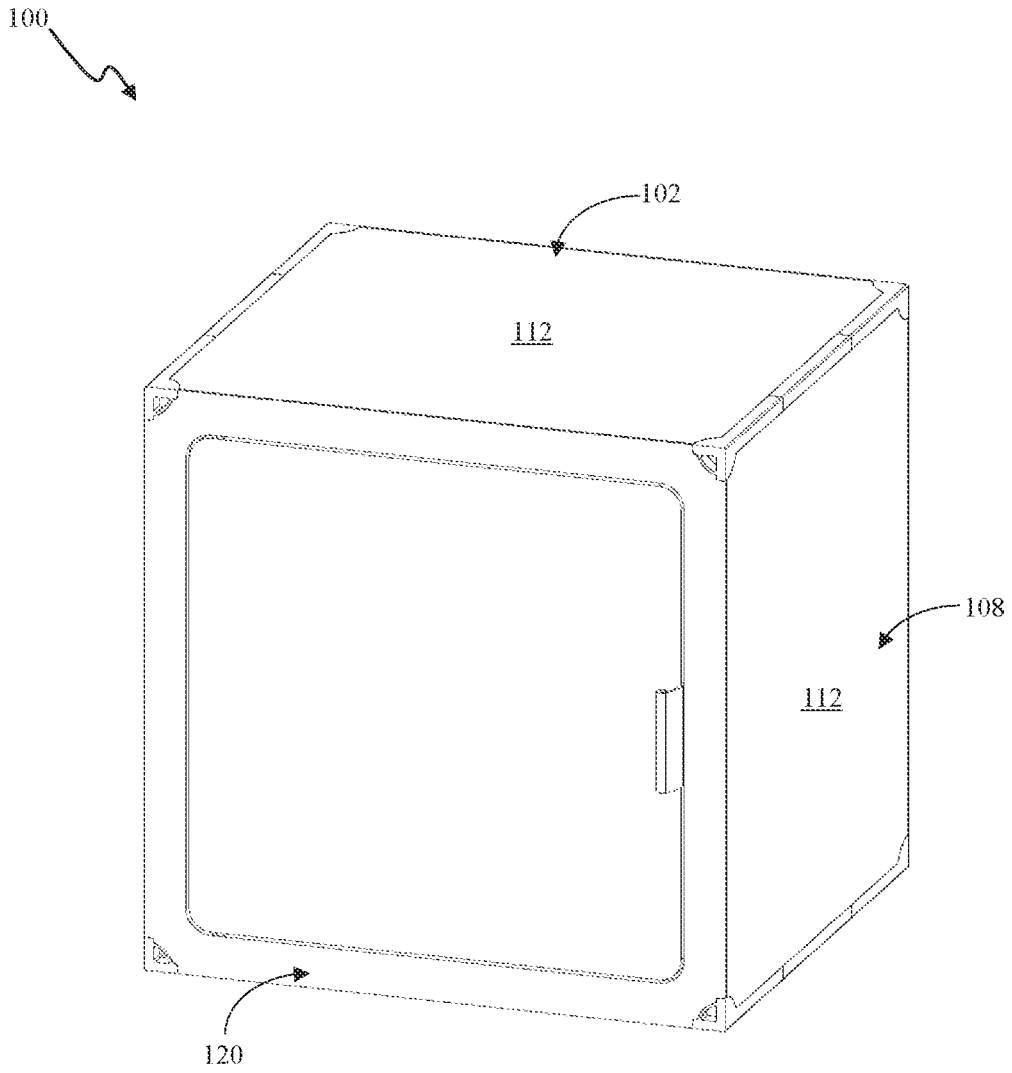
FIG. 1 is a front perspective view of an embodiment of a modular furniture unit.

The present disclosure provides a modular furniture system for forming one or more modular furniture units. It will be appreciated that the modular furniture system and the formed modular furniture units, as generally described herein and illustrated in the drawings can be arranged, substituted, combined, separated and designed in a wide variety of different configurations, all of which are contemplated in this disclosure.

Figure 2:
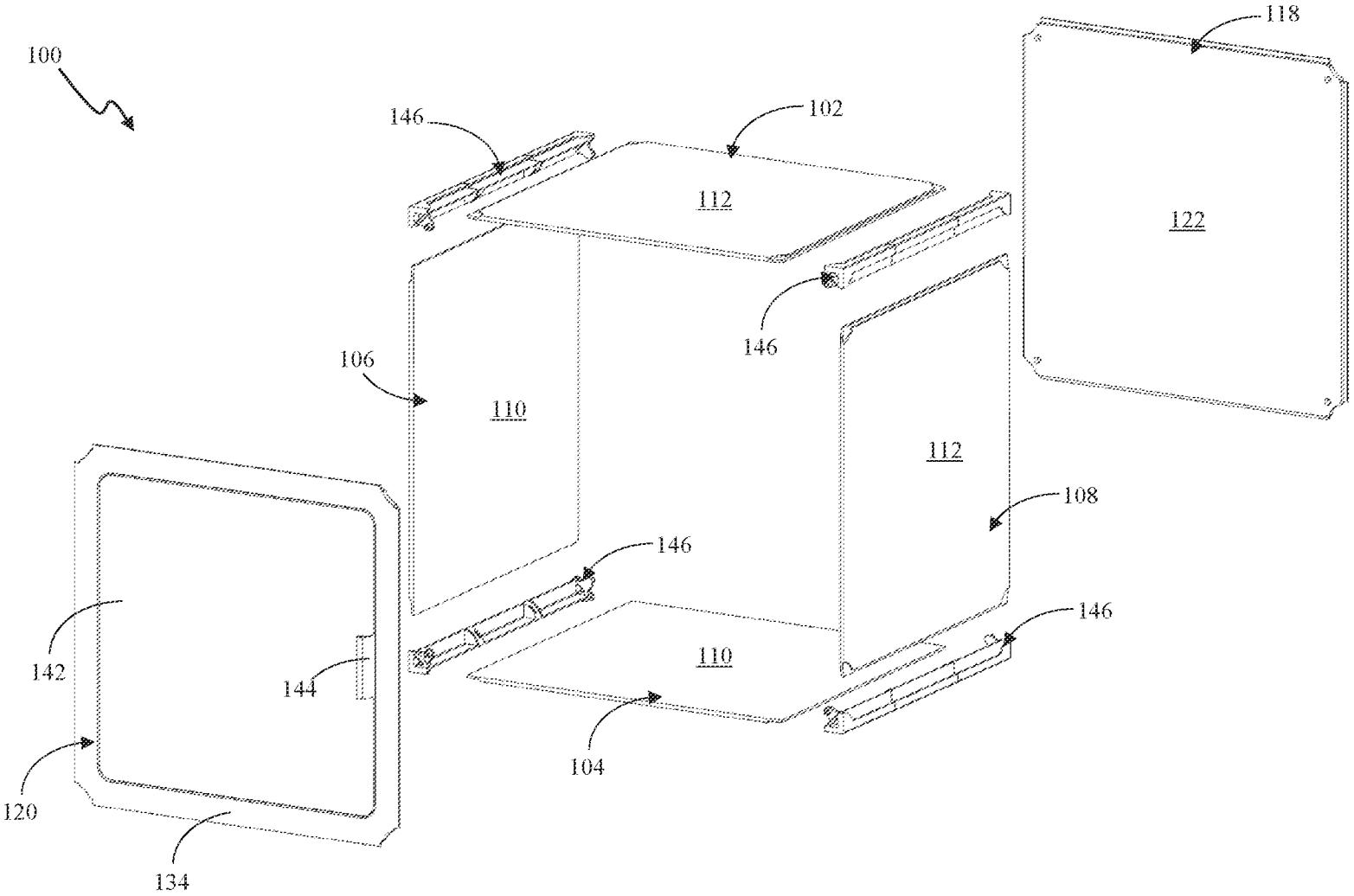
FIG. 2 is an exploded front perspective view of the modular furniture unit of FIG. 1.
Figure 3:
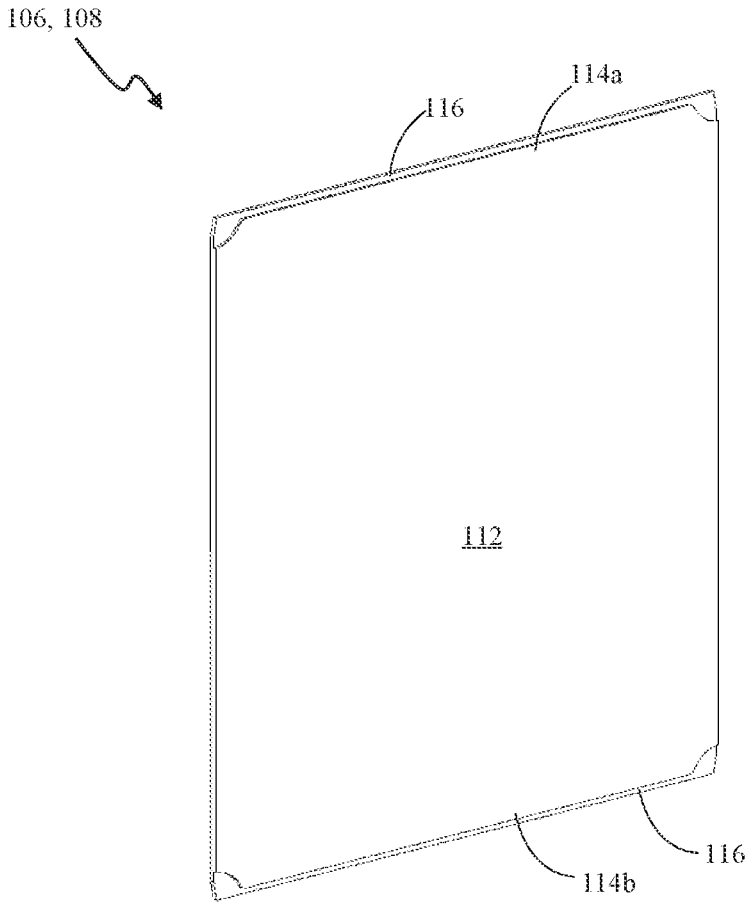
FIG. 3 is a front perspective view of a side wall of the modular furniture unit of FIG. 1.

FIGS. 1 and 2 show an embodiment of a modular furniture unit 100. The modular furniture unit 100 comprises a top side wall 102, a bottom side wall 104, a left side wall 106 and a right side wall 108. Each of the side walls 102, 104, 106, 108 has an interior surface 110, an exterior surface 112, and opposed edge portions 114*a*, 114*b*. Each of the opposed edge portions 114*a*, 114*b* is defined by a cut-out 116 on the exterior surface 112, as best shown in FIG. 3. The side walls 102, 104, 106, 108 are formed from a wood material, such as plywood, medium-density fibreboard, particle board, wood composite, or the like.

Figure 4:
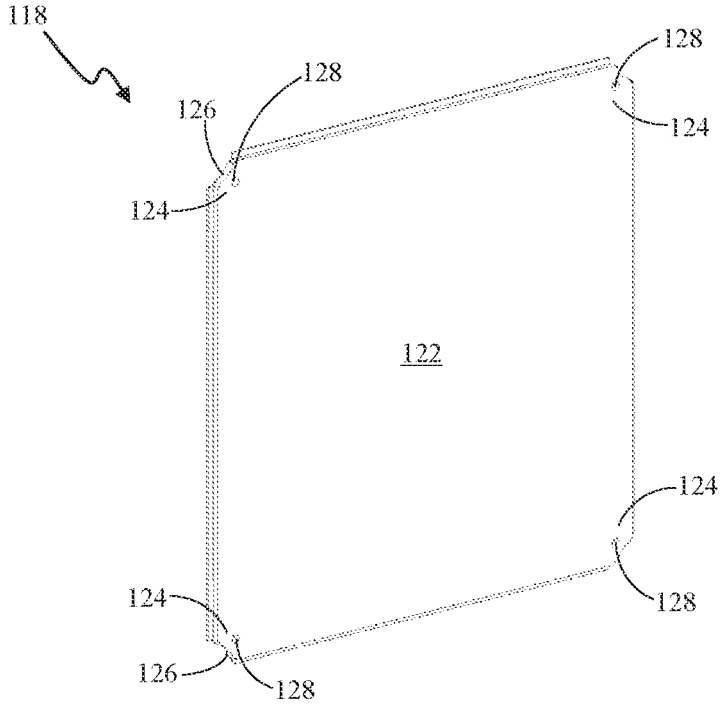
FIG. 4 is a front perspective view of a rear end wall of the modular furniture unit of FIG. 1.
Figure 5:
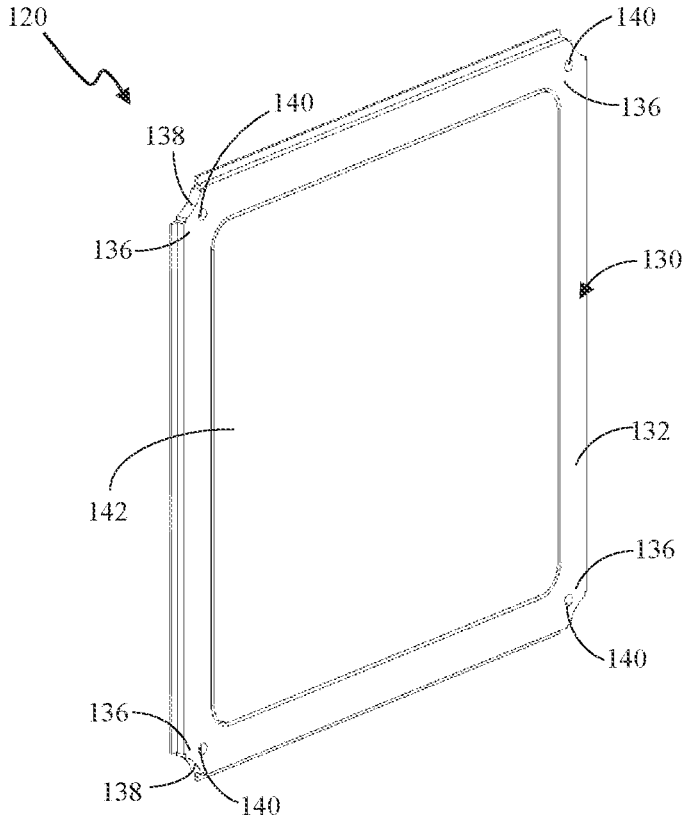
FIG. 5 is a rear perspective view of a front end wall of the modular furniture unit of FIG. 1.

The modular furniture unit 100 also comprises a rear end wall 118 and a front end wall 120. With reference to FIG. 4, the rear end wall 118 has an interior surface 122, an exterior surface (not shown) and four corner portions 124. Each of the corner portions 124 has an arcuate corner end surface 126. A recess 128 is defined on the interior surface 122 of each of the corner portions 124. With reference to FIG. 5, the front end wall 120 has a frame 130 with an interior surface 132 and an exterior surface 134. The front end wall 120 also has four corner portions 136 defined by the frame 130. Each of the corner portions 136 has an arcuate corner end surface 138. A recess 140 is defined on the interior surface 132 of each of the corner portions 136. In this embodiment, the front end wall 120 also has a door 142 that is hingedly connected to the frame 130. A handle 144 is provided on the door 142 to allow the door 142 to be easily opened and closed. In other embodiments, the front end wall 120 may not have a door. The rear end wall 118 and the front end wall 120 are formed from a wood material, such as plywood, medium-density fibreboard, wood composite, or the like.

Figure 6:
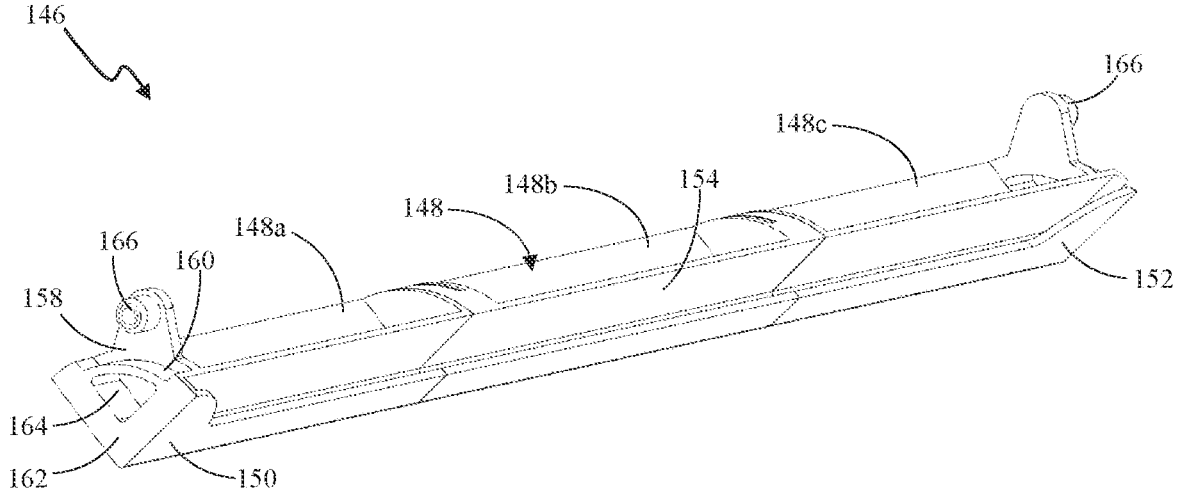
FIG. 6 is a front perspective view of an embodiment of a wall connector of the modular furniture unit of FIG. 1.
Figure 7:
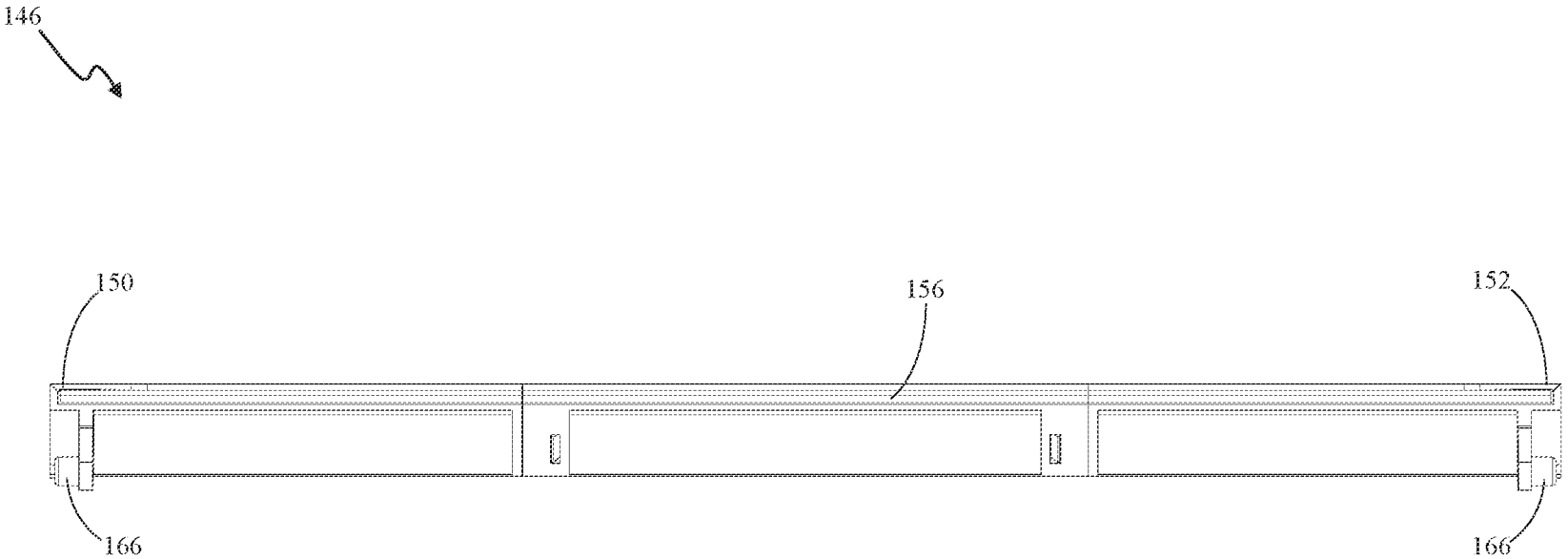
FIG. 7 is a side view of the wall connector of FIG. 6.

The modular furniture unit 100 further comprises four wall connectors 146 for connecting the side walls 102, 104, 106, 108 and the end walls 118, 120 together. In the embodiment shown in FIGS. 6 and 7, each of the wall connectors 146 has a rail 148 that extends between a first end portion 150 and a second end portion 152. The rail 148 comprises three parts 148*a*, 148*b*, 148*c* connected together. The rail 148 defines first and second channels 154, 156 that are each configured to fittingly receive one of the edge portions 114*a*, 114*b* of the side walls 102, 104, 106, 108 such that a side wall with its edge portion fittingly received in the first channel 154 is orthogonal to a side wall with its edge portion fittingly received in the second channel 156. Each of the end portions 150, 152 is configured to locate one of the corner portions 124, 136 of the end walls 118, 120. In this regard, each of the end portions 150, 152 comprises a planar locating surface 158, an arcuate ridge locating surface 160 corresponding to each of the corner end surfaces 126, 138, and a planar end surface 162 with an aperture 164 therein. Each of the end portions 150, 152 further comprises a protrusion 166 that extends from the planar locating surface 158. The protrusion 166 is sized and shaped to be fittingly received in one of the recesses 128, 140. The wall connectors 146 are formed from a plastics material, such as Acrylonitrile Butadiene Styrene, for example.

Figure 8:
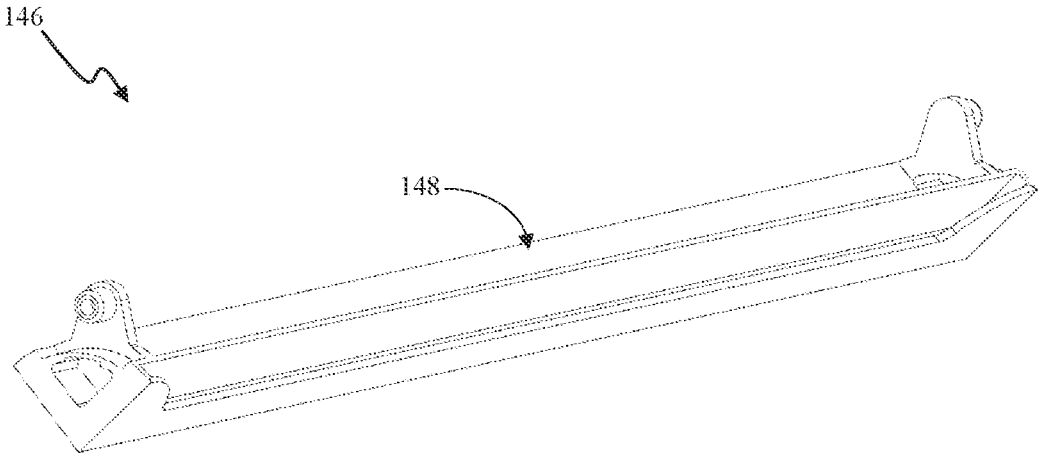
FIG. 8 is a front perspective view of another embodiment of a wall connector of the modular furniture unit of FIG. 1.

In some embodiments, the rail 148 comprises two or more parts connected together. In alternative embodiments, the rail 148 may be integrally formed, as shown in FIG. 8.

Assembly of the modular furniture unit 100 will now be described with reference to FIGS. 1 and 2. Each of the edge portions 114*a*, 114*b* of the side walls 102, 104, 106, 108 is fittingly received within one of the channels 154, 156 of the wall connectors 146 such that the top and bottom side walls 102, 104 are each orthogonal to the left and right side walls 106, 108. The rear end wall 118 is then connected by locating each of the corner portions 124 at one of the second end portions 152 of the wall connectors 146 such that the interior surface 122 of the corner portion 124 abuts the planar locating surface 158 and the corner end surface 126 of the corner portion 124 abuts the ridge locating surface 160. Abutment of the corner end surface 126 with the ridge locating surface 160 assists with limiting movement of the rear end wall 118 relative to the second end portions 152 of the wall connectors 146. Further, each of the protrusions 166 of the second end portions 152 is fittingly received in one of the recesses 128.

The front end wall 120 is also connected by locating each of the corner portions 136 at one of the first end portions 150 of the wall connectors 146 such that the interior surface 132 of the corner portion 136 abuts the planar locating surface 158 and the corner end surface 138 of the corner portion 136 abuts the ridge locating surface 160. Abutment of the corner end surface 138 with the ridge locating surface 160 assists with limiting movement of the front end wall 120 relative to the first end portions 150 of the wall connectors 146. Further, each of the protrusions 166 of the first end portions 150 is fittingly received in one of the recesses 140. When assembled, the modular furniture unit 100 defines a box with an internal chamber.

Figure 9:
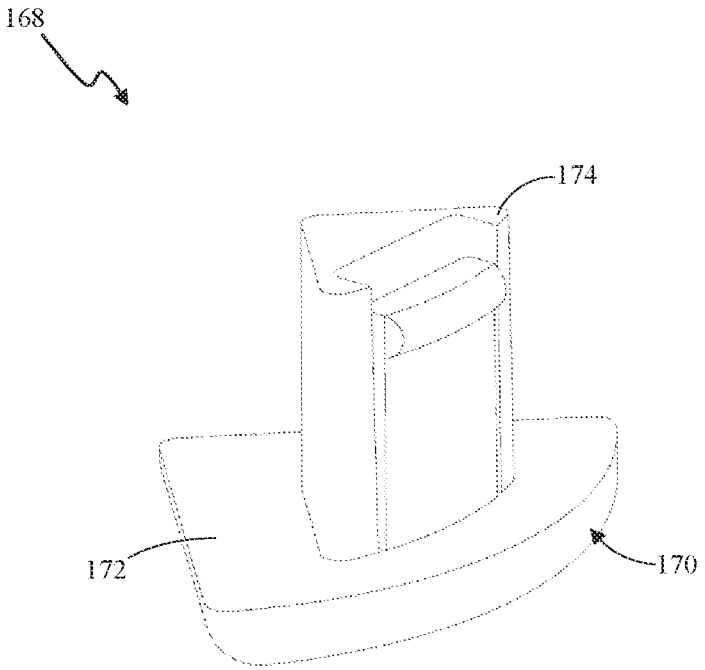
FIG. 9 is a rear perspective view of an embodiment of an end cap.
Figure 10:
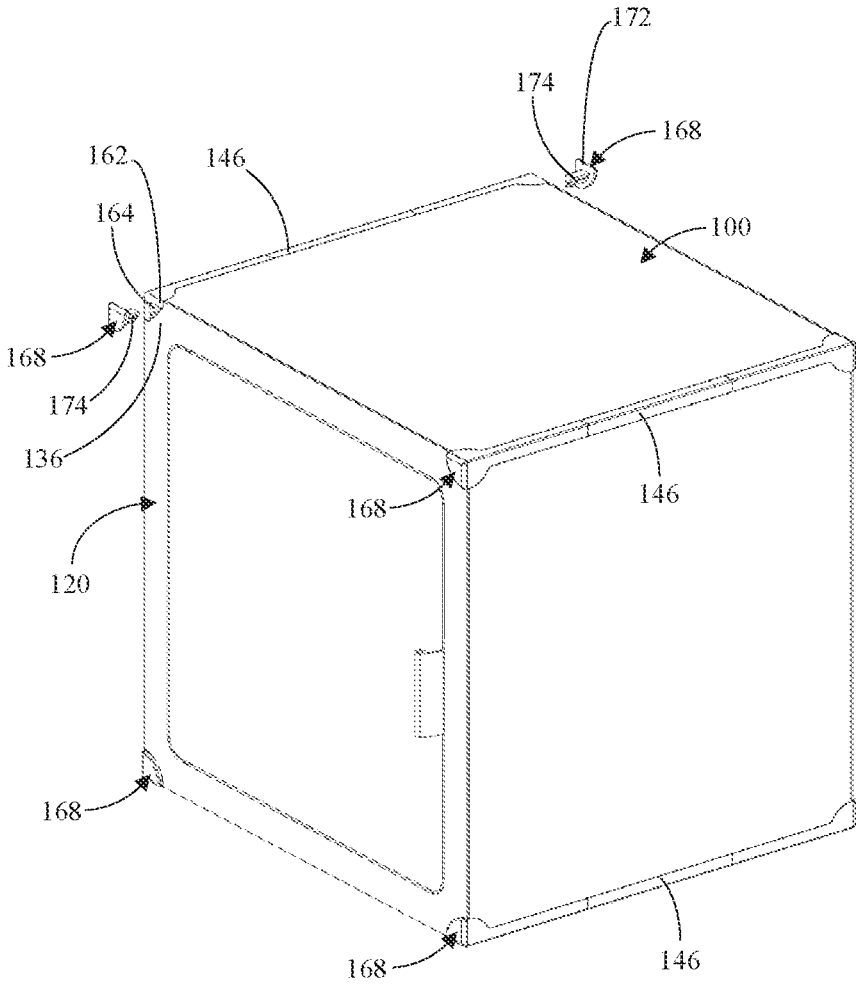
FIG. 10 is a front perspective view of the modular furniture unit of FIG. 1 with a plurality of the end caps of FIG. 9.

In some embodiments, the modular furniture system comprises a plurality of end caps for substantially securing the corner portions 124, 136 to the end portions 150, 152. The end caps are formed from a plastics material, such as Acrylonitrile Butadiene Styrene, for example. FIG. 9 shows an embodiment of an end cap 168. The end cap 168 comprises a head portion 170 with a planar abutment surface 172 and a pin portion 174 that extends from the head portion 170. The pin portion 174 is received in the aperture 164 of a respective end portion 150, 152 to form a snap lock connection therewith. The abutment surface 172 of the head portion 170 also abuts the planar end surface 162 and the corner portion 124, 136 to secure the corner portion 124, 136 to the end portion 150, 152. In the embodiment shown in FIG. 10, eight end caps 168 are each connected at respective end portions 150, 152 of the wall connectors 146 to prevent the end walls 118, 120 from being dislodged.

Figure 11:
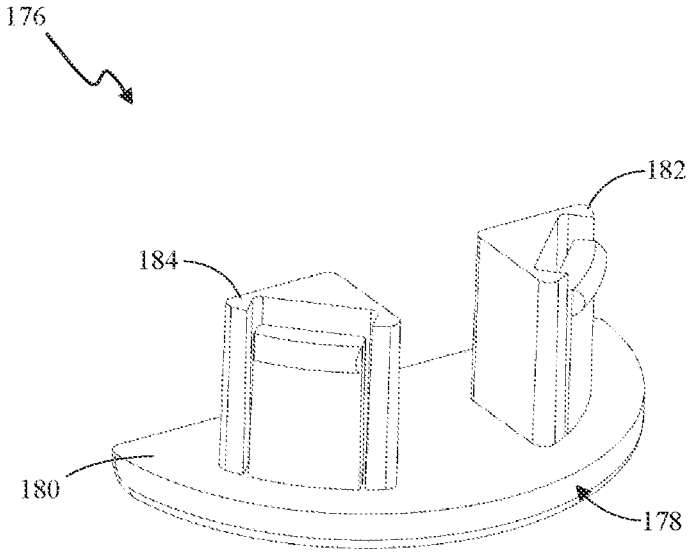
FIG. 11 is a rear perspective view of another embodiment of an end cap.
Figure 12:
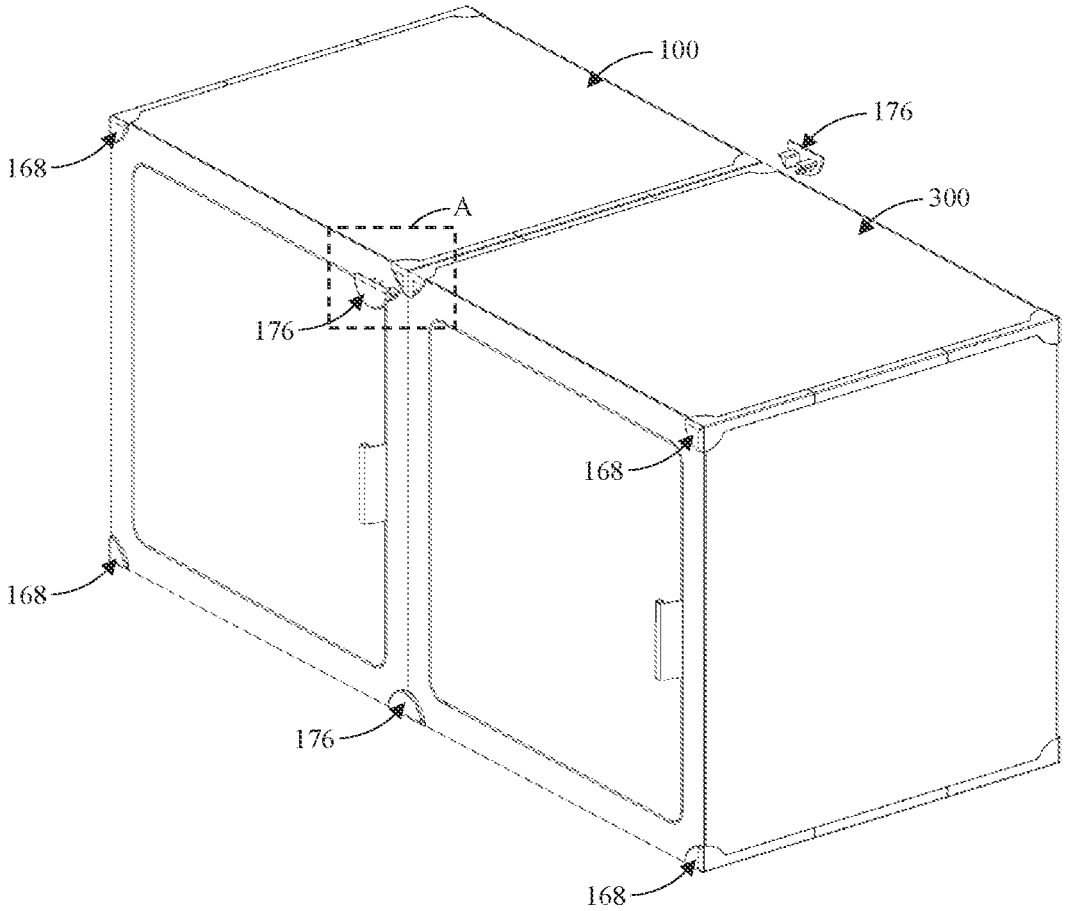
FIG. 12 is a front perspective view of a modular furniture system with two modular furniture units being connected together.
Figure 13:
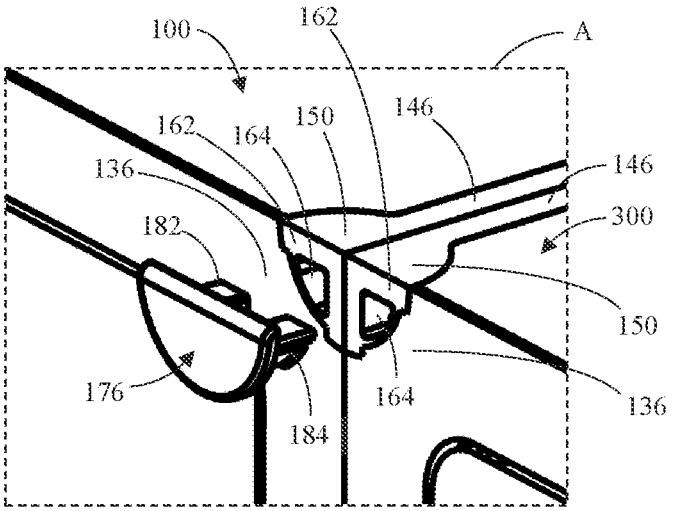
FIG. 13 is an enlarged view of A of FIG. 12.

FIG. 11 shows another embodiment of an end cap 176. The end cap 176 comprises a head portion 178 with a planar abutment surface 180 and two pin portions 182, 184 that extend from the head portion 178. The end cap 176 is used for connecting two modular furniture units together. For example, as shown in FIG. 12, four end caps 176 are used to connect the modular furniture unit 100 to a modular furniture unit 300. The further modular furniture unit 300 is substantially similar to the modular furniture unit 100 and like features have been indicated with like reference numerals. FIG. 13 shows the connection of one of the end caps 176. The pin portion 182 is received in the aperture 164 of the first end portion 150 of the wall connector 146 of the modular furniture unit 100 to form a snap lock connection therewith, and the pin portion 184 is received in the aperture 164 of the first end portion 150 of the wall connector 146 of the modular furniture unit 300 to form a snap lock connection therewith such that the modular furniture unit 100 is connected to the modular furniture unit 300. The abutment surface 180 of the head portion 178 also abuts the planar end surfaces 162 and the corner portions 136 to secure the corner portions 136 to the first end portions 150. It will be appreciated that each of the end caps 176 are connected in a similar manner.

Figure 14:
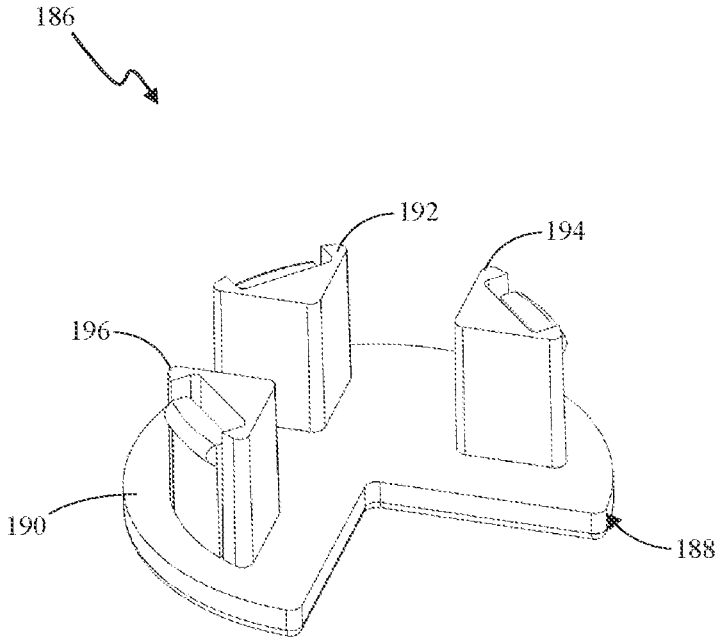
FIG. 14 is a rear perspective view of another embodiment of an end cap.
Figure 15:
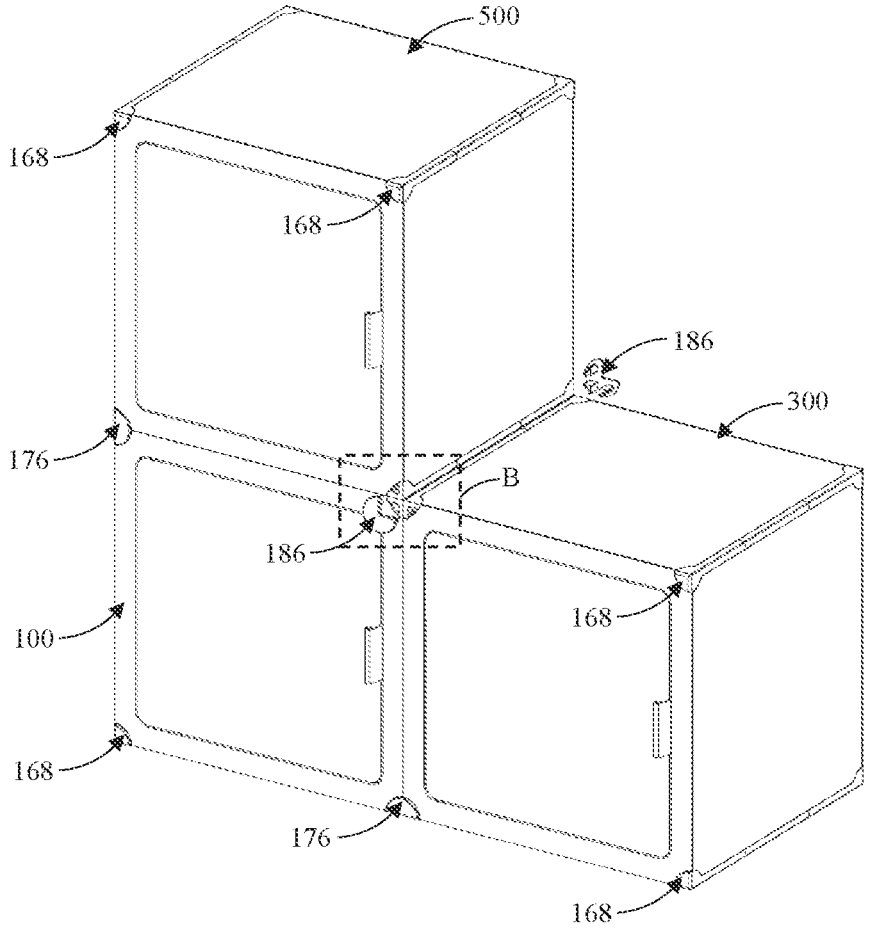
FIG. 15 is a front perspective view of a modular furniture system with three modular furniture units being connected together in a stepped-configuration.
Figure 16:
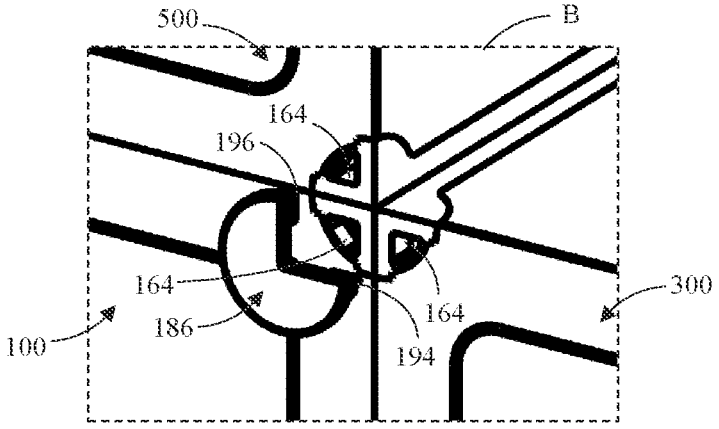
FIG. 16 is an enlarged view of B of FIG. 15.

FIG. 14 shows another embodiment of an end cap 186. The end cap 186 comprises a head portion 188 with a planar abutment surface 190 and three pin portions 192, 194, 196 that extend from the head portion 188. The end cap 186 is used for connecting three modular furniture units together. For example, as shown in FIG. 15, two end caps 186 are used to connect the modular furniture unit 100, the modular furniture unit 300 and a modular furniture unit 500 together in a stepped-configuration. The modular furniture unit 500 is substantially similar to the modular furniture unit 100 and like features have been indicated with like reference numerals. FIG. 16 shows the connection of one of the end caps 186. The pin portion 192 is received in the aperture 164 of the first end portion 150 of the wall connector 146 of the modular furniture unit 100 to form a snap lock connection therewith, the pin portion 194 is received in the aperture 164 of the first end portion 150 of the wall connector 146 of the modular furniture unit 300 to form a snap lock connection therewith, and the pin portion 196 is received in the aperture 164 of the first end portion 150 of the wall connector 146 of the modular furniture unit 500 to form a snap lock connection therewith such that the modular furniture units 100, 300, 500 are connected together. The abutment surface 190 of the head portion 188 also abuts the planar end surfaces 162 and the corner portions 136 to secure the corner portions 136 to the first end portions 150. It will be appreciated that each of the end caps 186 are connected in a similar manner. Additionally, a series of end caps 176 are used to further secure the modular furniture units 100, 300, 500 together.

Figure 17:
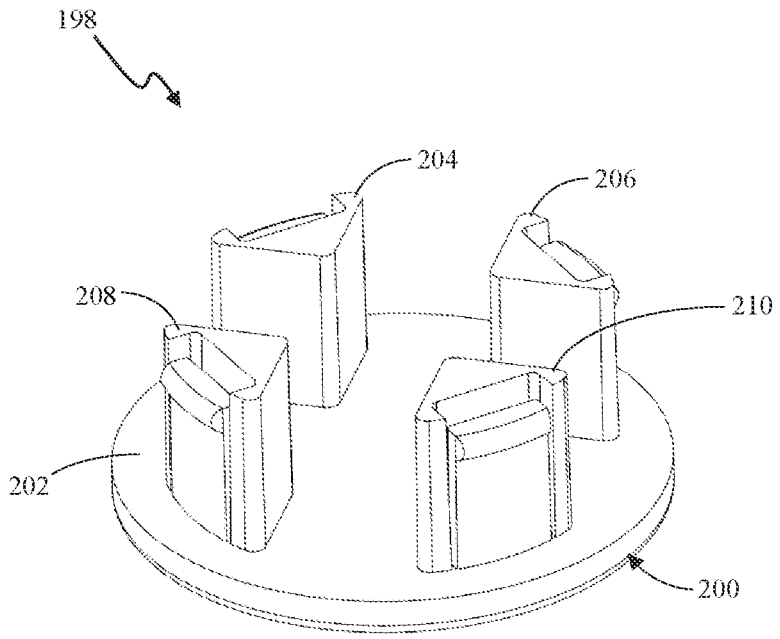
FIG. 17 is a rear perspective view of another embodiment of an end cap.
Figure 18:
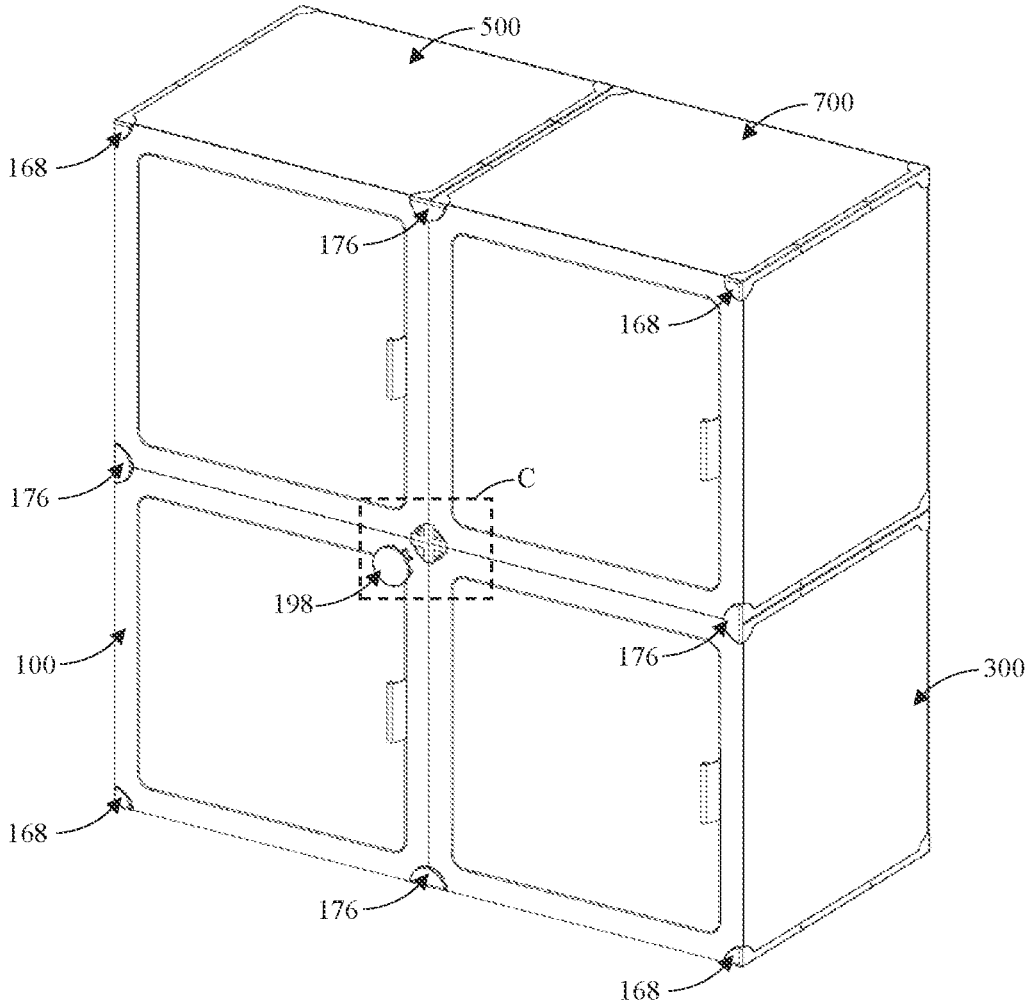
FIG. 18 is a front perspective view of a modular furniture system with four modular furniture units being connected together.
Figure 19:
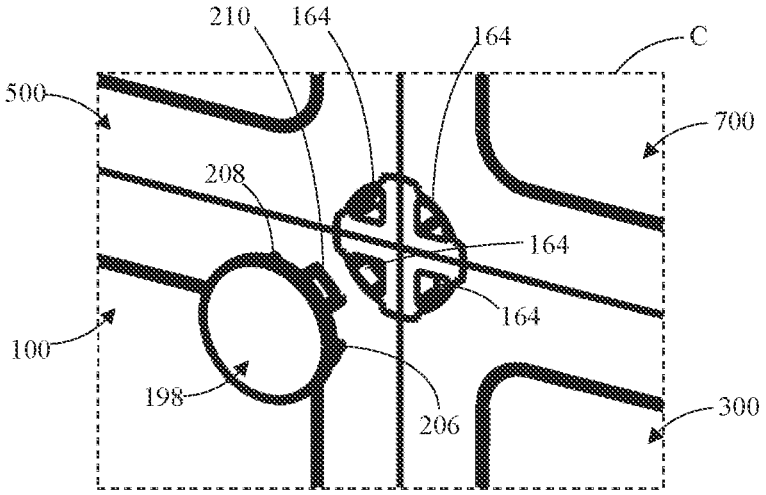
FIG. 19 is an enlarged view of C of FIG. 18.

FIG. 17 shows a further embodiment of an end cap 198. The end cap 198 comprises a head portion 200 with a planar abutment surface 202 and four pin portions 204, 206, 208, 210 that extend from the head portion 200. The end cap 198 is used for connecting four modular furniture units together. For example, as shown in FIG. 18, two end caps 198 are used to connect the modular furniture unit 100, the modular furniture unit 300, the modular furniture unit 500 and a modular furniture unit 700 together. The modular furniture unit 700 is substantially similar to the modular furniture unit 100 and like features have been indicated with like reference numerals. FIG. 19 shows the connection of one of the end caps 198. The pin portion 204 is received in the aperture 164 of the first end portion 150 of the wall connector 146 of the modular furniture unit 100 to form a snap lock connection therewith, the pin portion 206 is received in the aperture 164 of the first end portion 150 of the wall connector 146 of the modular furniture unit 300 to form a snap lock connection therewith, the pin portion 208 is received in the aperture 164 of the first end portion 150 of the wall connector 146 of the modular furniture unit 500 to form a snap lock connection therewith, and the pin portion 210 is received in the aperture 164 of the first end portion 150 of the wall connector 146 of the modular furniture unit 700 to form a snap lock connection therewith such that the modular furniture units 100, 300, 500, 700 are connected together. The abutment surface 202 of the head portion 200 also abuts the planar end surfaces 162 and the corner portions 136 to secure the corner portions 136 to the first end portions 150. It will be appreciated that each of the end caps 198 are connected in a similar manner. Additionally, a series of end caps 176 are used to further secure the modular furniture units 100, 300, 500, 700 together.

Figure 20:
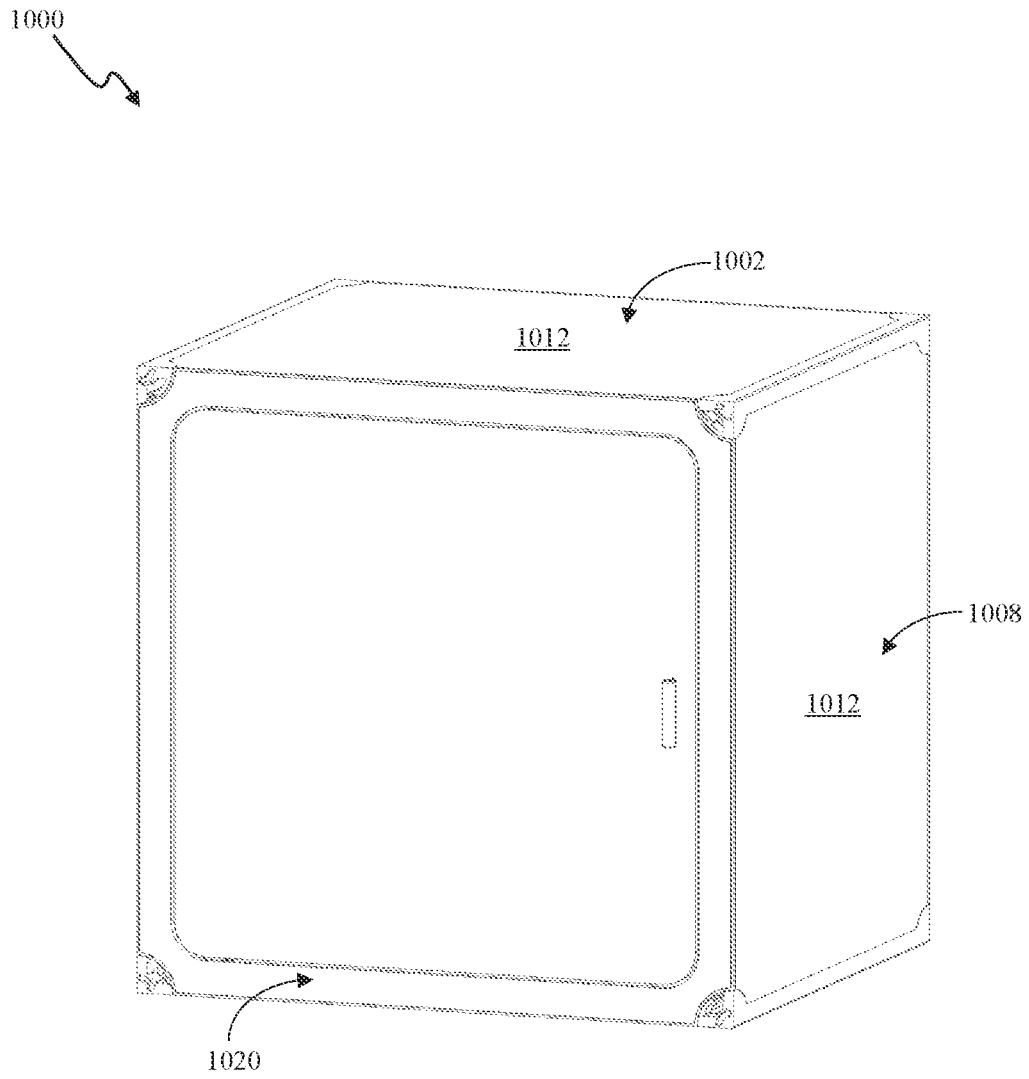
FIG. 20 is a front perspective view of another embodiment of a modular furniture unit.
Figure 21:
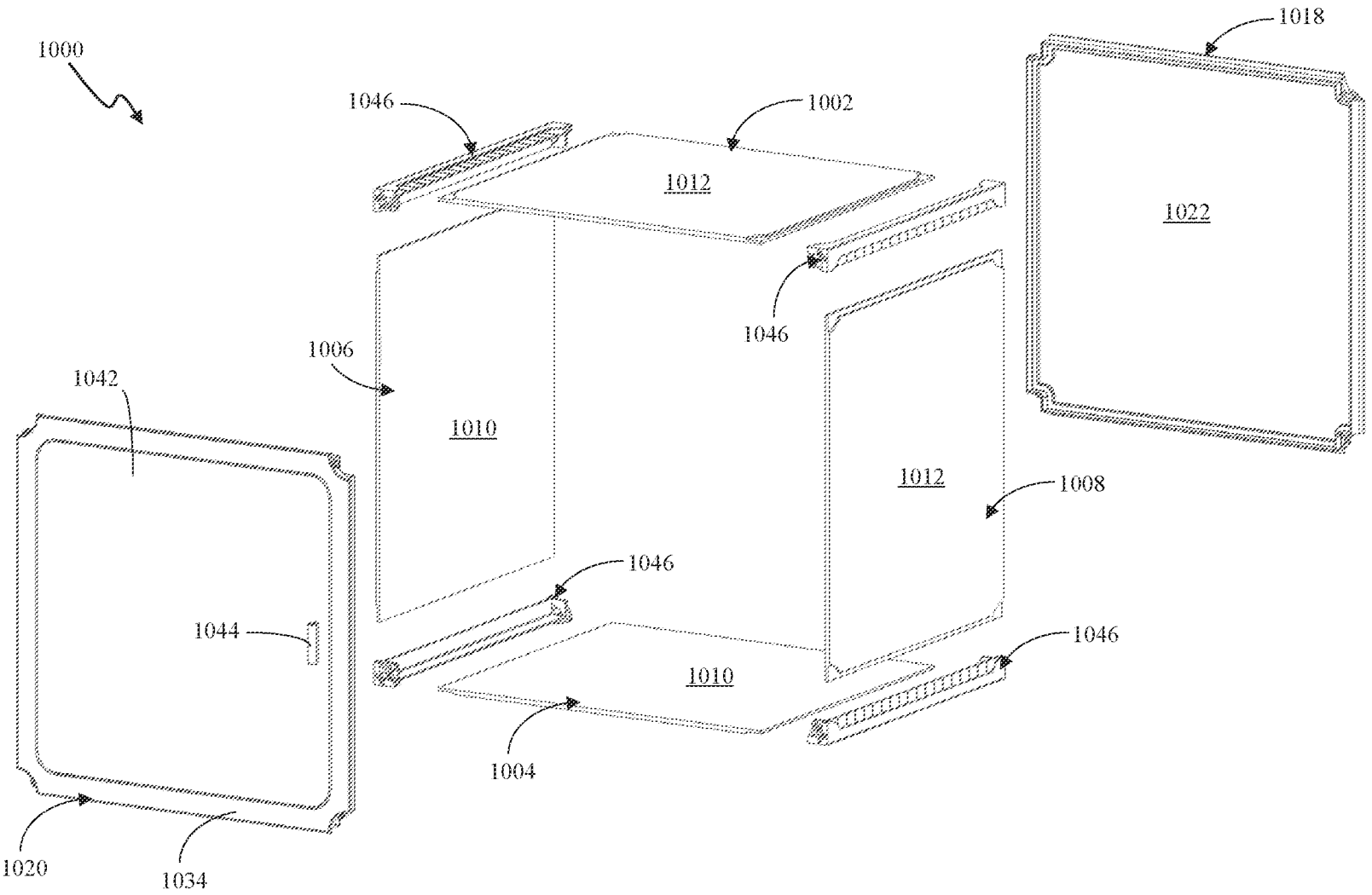
FIG. 21 is an exploded front perspective view of the modular furniture unit of FIG. 20.
Figure 22:
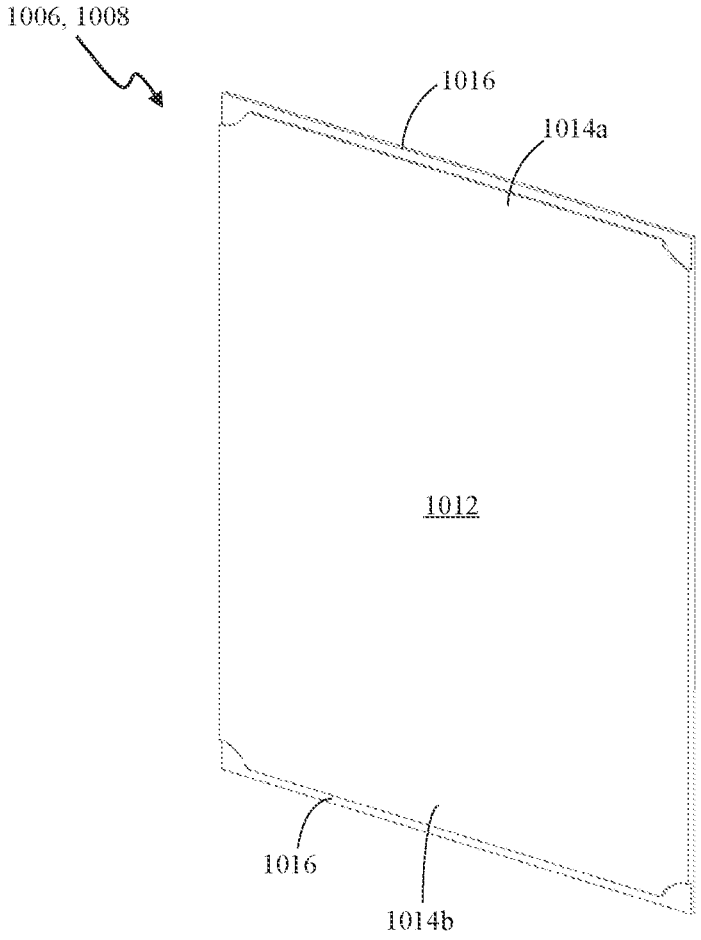
FIG. 22 is a front perspective view of a side wall of the modular furniture unit of FIG. 20.

FIGS. 20 and 21 show another embodiment of a modular furniture unit 1000. The modular furniture unit 1000 comprises a top side wall 1002, a bottom side wall 1004, a left side wall 1006 and a right side wall 1008. Each of the side walls 1002, 1004, 1006, 1008 has an interior surface 1010, an exterior surface 1012, and opposed edge portions 1014*a*, 1014*b*. Each of the opposed edge portions 1014*a*, 1014*b* is defined by a cut-out 1016 on the exterior surface 1012, as best shown in FIG. 22. The side walls 1102, 1104, 1106, 1108 are formed from a wood material, such as plywood, medium-density fibreboard, particle board, wood composite, or the like.

Figure 23:
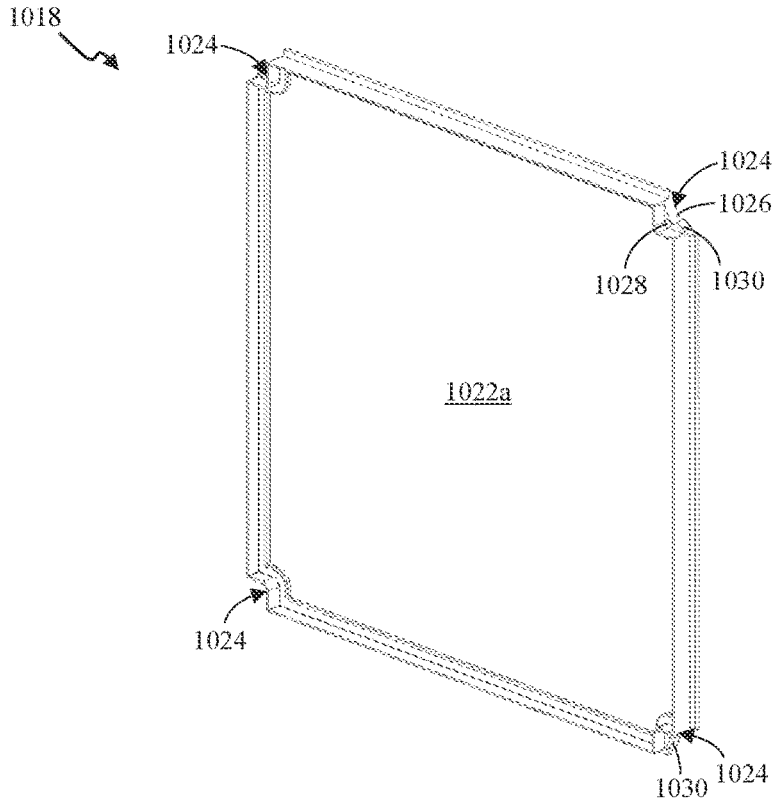
FIG. 23 is a front perspective view of a rear end wall of the modular furniture unit of FIG. 20.
Figure 24:
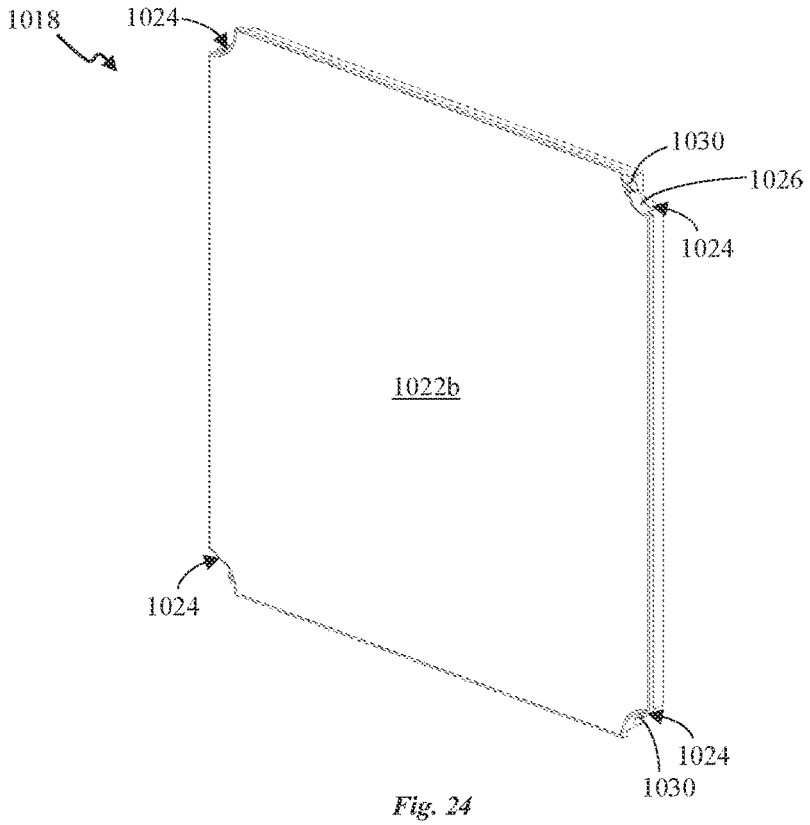
FIG. 24 is a rear perspective view of the rear end wall of FIG. 23.
Figure 25:
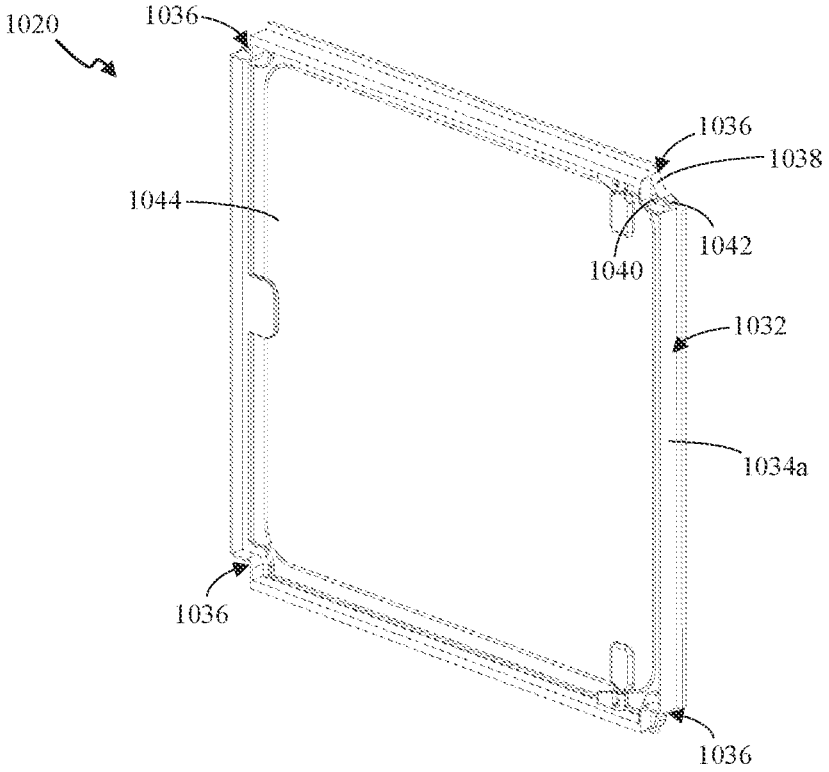
FIG. 25 is a rear perspective view of a front end wall of the modular furniture unit of FIG. 20.
Figure 26:
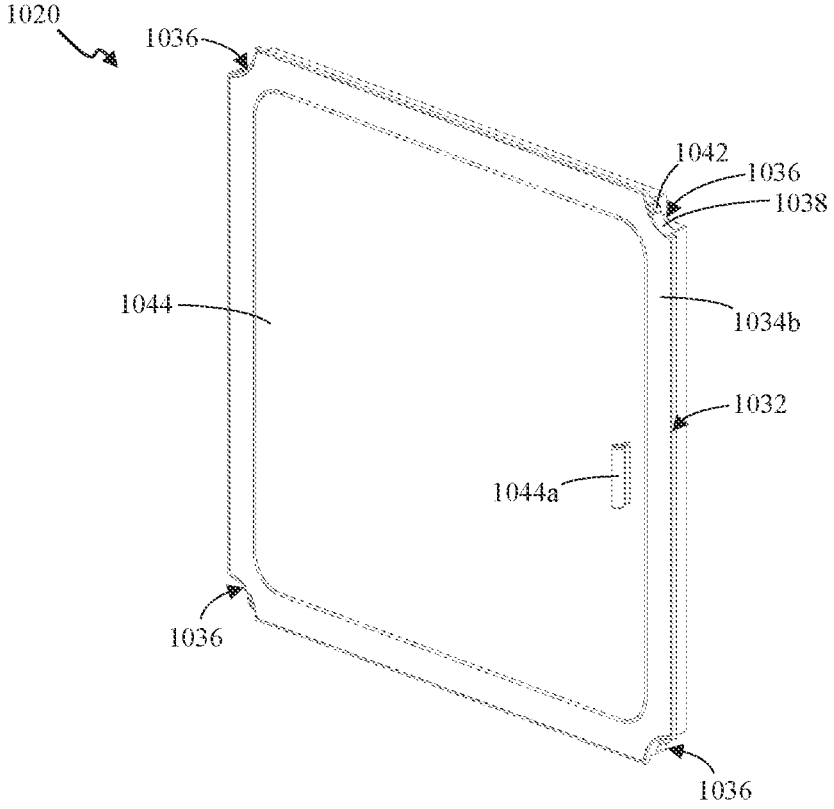
FIG. 26 is a front perspective view of a front end wall of FIG. 25.

The modular furniture unit 1000 also comprises a rear end wall 1018 and a front end wall 1020. With reference to FIGS. 23 and 24, the rear end wall 1018 has an interior surface 1022*a*, an exterior surface 1022*b* and four corner portions 1024. Each of the corner portions 1024 has an arcuate corner end surface 1026. A recess 1028 is defined on the interior surface 1022 of each of the corner portions 1024. Further, a tab 1030 is provided in each of the corner portions 1024. With reference to FIGS. 25 and 26, the front end wall 1020 has a frame 1032 with an interior surface 1034*a* and an exterior surface 1034*b*. The front end wall 1020 also has four corner portions 1036 defined by the frame 1032. Each of the corner portions 1036 has an arcuate corner end surface 1038. A recess 1040 is defined on the interior surface 1034*a* of each of the corner portions 1036. Further, a tab 1042 is provided in each of the corner portions 1036. In this embodiment, the front end wall 1020 also has a door 1044 that is hingedly connected to the frame 1032. A handle 1044*a* is provided on the door 1044 to allow the door 1044 to be easily opened and closed. The rear end wall 1018 and the front end wall 1020 are formed from a wood material, such as plywood, medium-density fibreboard, wood composite, or the like.

Figure 27:
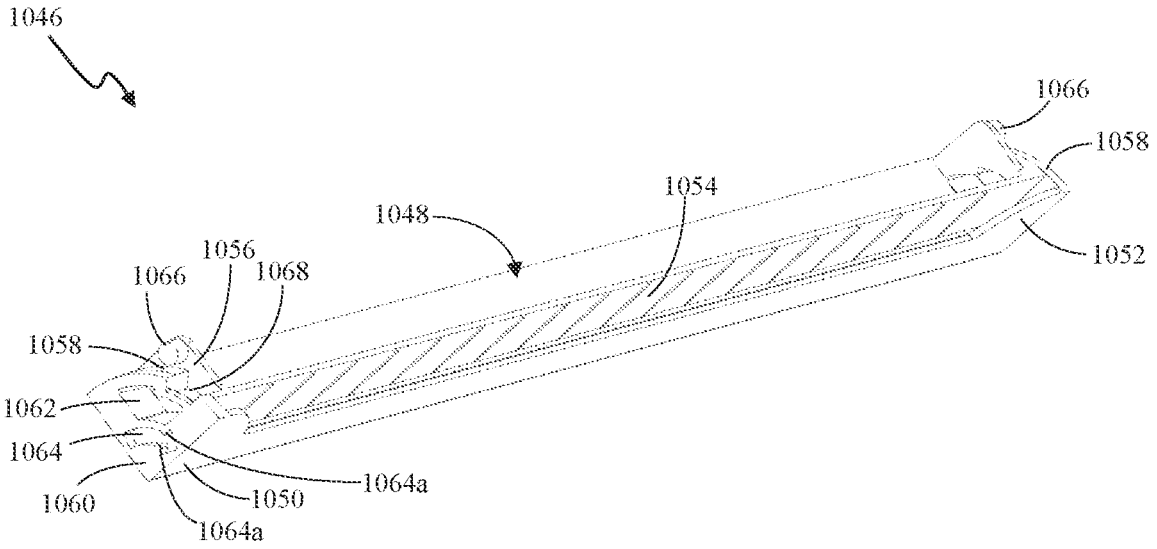
FIG. 27 is a front perspective view of an embodiment of a wall connector of the modular furniture unit of FIG. 20.

The modular furniture unit 1000 further comprises four wall connectors 1046 for connecting the side walls 1002, 1004, 1006, 1008 and the end walls 1018, 1020 together. In the embodiment shown in FIG. 27, each of the wall connectors 1046 has a rail 1048 that extends between a first end portion 1050 and a second end portion 1052. The rail 1048 defines a first channel 1054 and a second channel (not shown) that are each configured to fittingly receive one of the edge portions 1014*a*, 1014*b* of the side walls 1002, 1004, 1006, 1008 such that a side wall with its edge portion fittingly received in the first channel 1054 is orthogonal to a side wall with its edge portion fittingly received in the second channel. Each of the end portions 1050, 1052 is configured to engage one of the corner portions 1024, 1036 of the end walls 1018, 1020 for attachment thereto. In this regard, each of the end portions 1050, 1052 comprises a planar locating surface 1056, an arcuate ridge locating surface 1058 corresponding to each of the corner end surfaces 1026, 1038, and a planar end surface 1060 with first and second apertures 1062, 1064 therein. The second aperture 1064 defines a locking member 1064*a* in the form of two opposed flange portions 1064*a*. Each of the end portions 1050, 1052 further comprises a protrusion 1066 that extends from the planar locating surface 1056. The protrusion 1066 is sized and shaped to be fittingly received in one of the recesses 1028, 1040. Further, each of the end portions 1050, 1052 defines a recess 1068 on the arcuate ridge locating surface 1058. The wall connectors 1046 are formed from a plastics material, such as Acrylonitrile Butadiene Styrene, for example.

Assembly of the modular furniture unit 1000 will now be described with reference to FIGS. 20 and 21. Each of the edge portions 1014*a*, 1014*b* of the side walls 1002, 1004, 1006, 1008 is fittingly received within one of the channels 1054 of the wall connectors 1046 such that the top and bottom side walls 1002, 1004 are each orthogonal to the left and right side walls 1006, 1008. The rear end wall 1018 is then connected by locating each of the corner portions 1024 at one of the second end portions 1052 of the wall connectors 1046 such that the interior surface 1022*a* of the corner portion 1024 abuts the planar locating surface 1056 and the corner end surface 1026 of the corner portion 1024 abuts the ridge locating surface 1058. Abutment of the corner end surface 1026 with the ridge locating surface 1058 assists with limiting movement of the rear end wall 1018 relative to the second end portions 1052 of the wall connectors 1046. Each of the protrusions 1066 of the second end portions 1052 is also fittingly received in one of the recesses 1028. Further, each of the tabs 1030 of the rear end wall 1018 is received in a respective recess 1068 of one of the second end portions 1052 of the wall connectors 1046 to form a snap lock connection therewith, such that the rear end wall 1018 is securely attached to the wall connectors 1046.

The front end wall 1020 is also connected by locating each of the corner portions 1036 at one of the first end portions 1050 of the wall connectors 1046 such that the interior surface 1034*a* of the corner portion 1036 abuts the planar locating surface 1056 and the corner end surface 1038 of the corner portion 1036 abuts the ridge locating surface 1058. Abutment of the corner end surface 1038 with the ridge locating surface 1058 assists with limiting movement of the front end wall 1020 relative to the first end portions 1050 of the wall connectors 1046. Each of the protrusions 1066 of the first end portions 1050 is also fittingly received in one of the recesses 1040. Further, each of the tabs 1042 of the front end wall 1020 is received in a respective recess 1068 of one of the first end portions 1050 of the wall connectors 1046 to form a snap lock connection therewith, such that the front end wall 1020 is securely attached to the wall connectors 1046. When assembled, the modular furniture unit 1000 defines a box with an internal chamber, as best shown in FIG. 20.

Figure 28:
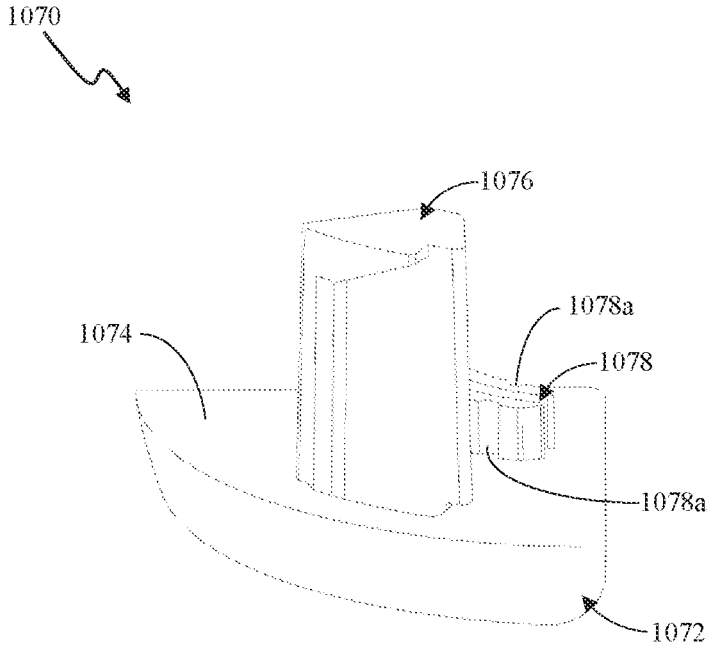
FIG. 28 is a rear perspective view of another embodiment of an end cap.
Figure 29:
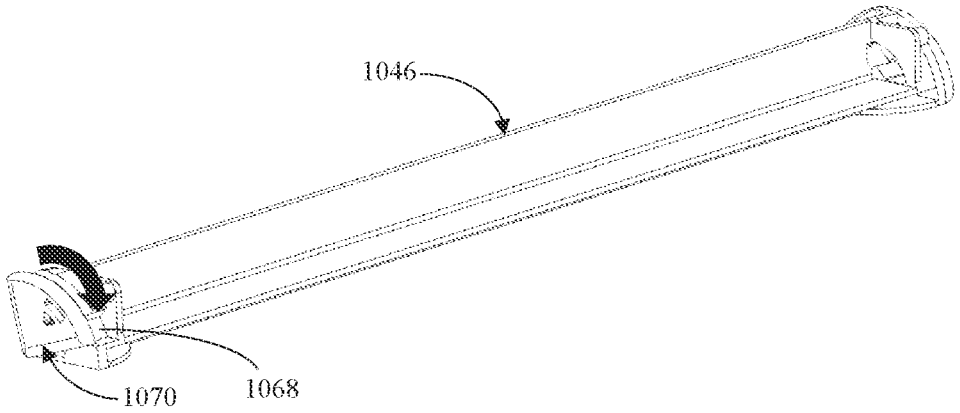
FIG. 29 is a front perspective view of the end cap of FIG. 28 being connected to the wall connector of FIG. 27.
Figure 30:
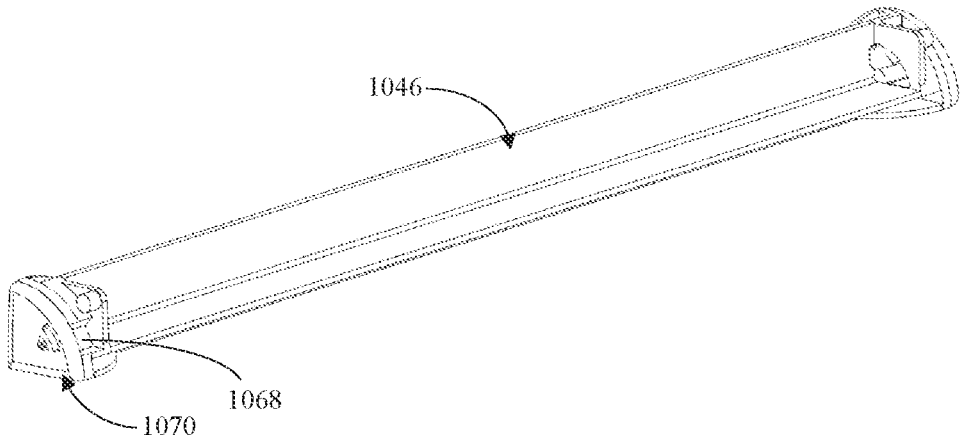
FIG. 30 is a front perspective view of the end cap of FIG. 28 connected to the wall connector of FIG. 27.
Figure 31:
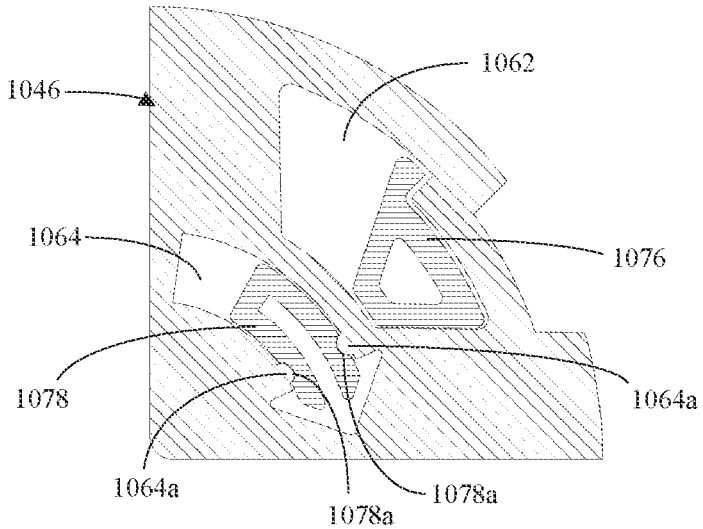
FIG. 31 is a cross-sectional view of FIG. 30.
Figure 32:
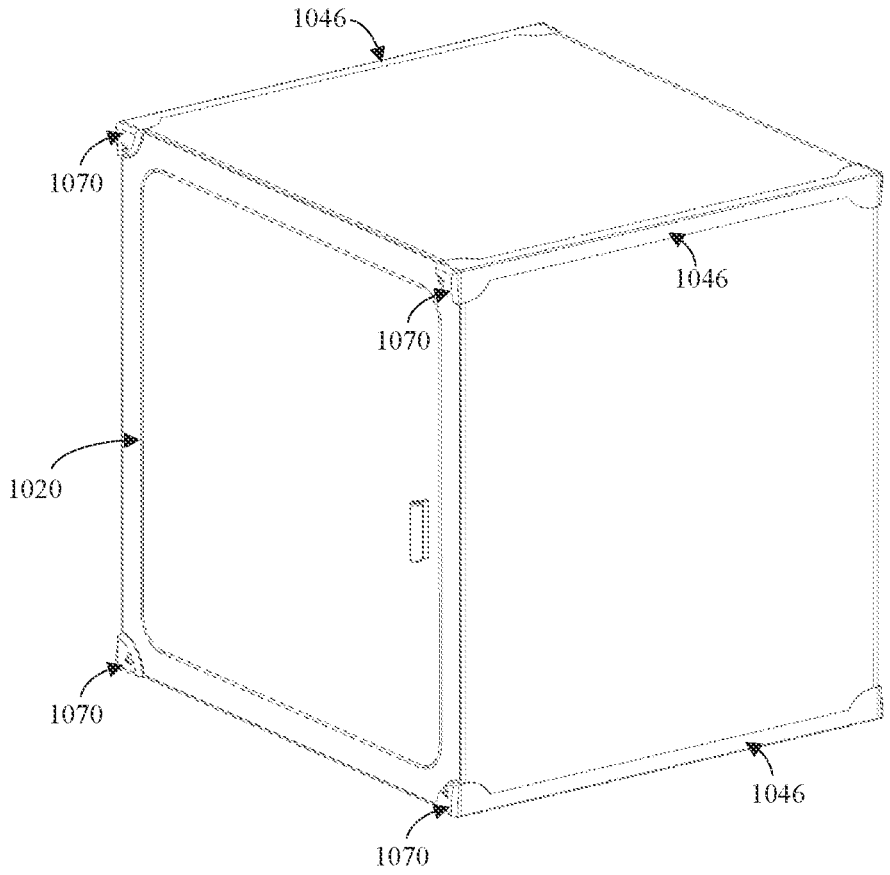
FIG. 32 is a front perspective view of the modular furniture unit of FIG. 20 with a plurality of the end caps of FIG. 28.

In some embodiments, the modular furniture system comprises a plurality of end caps. The end caps are formed from a plastics material, such as Acrylonitrile Butadiene Styrene, for example. FIG. 28 shows an embodiment of an end cap 1070. The end cap 1070 comprises a head portion 1072 with a planar abutment surface 1074, and a connecting pin portion 1076 and a locking pin portion 1078 that extend from the head portion 1070. The locking pin 1078 defines two opposed slot 1078*a*. The connecting pin portion 1076 and the locking pin portion 1078 are received in the respective first and second apertures 1062, 1064 of a respective end portion 1050, 1052 (FIG. 29). The first and second apertures 1062, 1064 are sized and shaped to ensure that the connecting pin portion 1076 and locking pin portion 1078 are only inserted in one orientation. The end cap 1070 is then rotated in the clockwise direction relative to the wall connector 1046 (FIG. 30), which causes a surface of the connecting pin portion 1076 to abut with a surface of one of the end portions 1050, 1052 with increasing friction in a bayonet arrangement and the flange portions 1064*a* to be received in the slots 1078*a* to form a snap lock connection therewith (FIG. 31), thereby securing the end cap 1070 to the wall connector 1046. The abutment surface 1074 of the head portion 1072 also abuts the planar end surface 1060 and substantially covers the recess 1068 to further prevent the tab 1030, 1042 from being dislodged from the recess 1068. In other embodiments, the end cap 1070 may be rotated in the anticlockwise direction relative to the wall connector 1046 to secure the end cap 1070 to the wall connector 1046. In the embodiment shown in FIG. 32, eight end caps 1070 are each connected at respective end portions 1050, 1052 of the wall connectors 1046.

Figure 33:
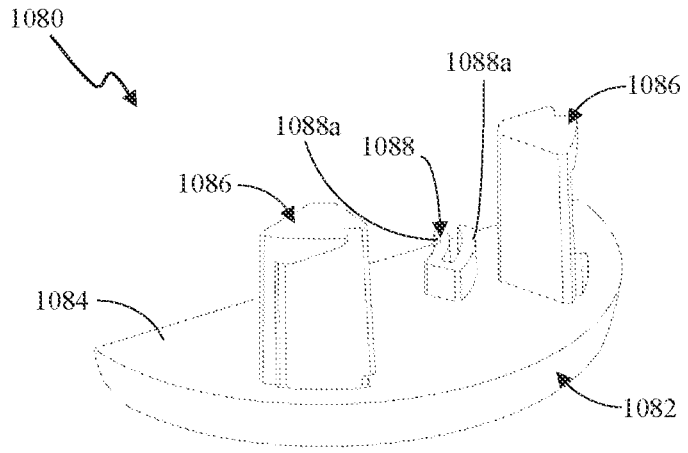
FIG. 33 is a rear perspective view of another embodiment of an end cap.
Figure 34:
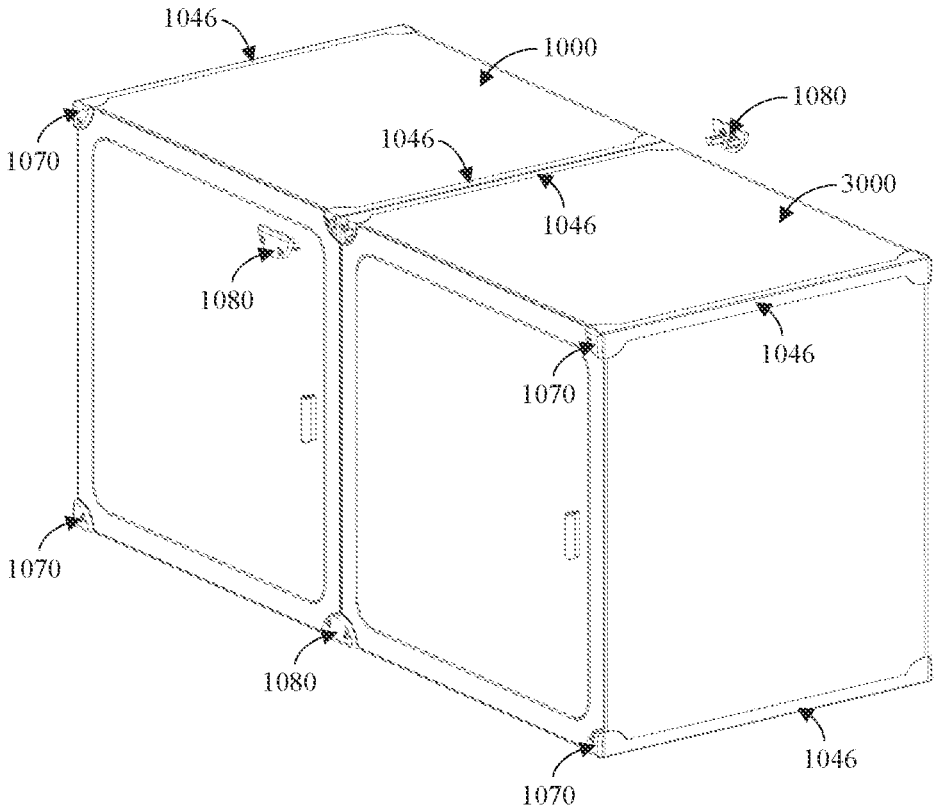
FIG. 34 is a front perspective view of a modular furniture system with two modular furniture units being connected together.

FIG. 33 shows another embodiment of an end cap 1080. The end cap 1080 comprises a head portion 1082 with a planar abutment surface 1084, and two connecting pin portions 1086 and two locking pin portions 1088 that extend from the head portion 1082. Each of the locking pin portions 1088 defines two opposed slots 1088*a*. The end cap 1080 is used for connecting two modular furniture units together. For example, as shown in FIG. 34, four end caps 1080 are used to connect the modular furniture unit 1000 to a modular furniture unit 3000. The further modular furniture unit 3000 is substantially similar to the modular furniture unit 1000 and like features have been indicated with like reference numerals. Each of the end caps 1080 is connected in a similar manner to that described above with respect to the end cap 1070, in which the connecting pin portions 1086 and the locking pin portions 1088 are received in the respective first and second apertures 1062, 1064 of the wall connectors 1046 of the modular furniture units 1000, 3000, and the end cap 1080 is rotated in a clockwise direction relative to the wall connectors 1046 such that the connecting pin portions 1086 engage with the respective end portions 1050, 1052 in a bayonet arrangement and the flange portions 1064*a* are received in the slots 1088*a* to form a snap lock connection therewith, thereby connecting the modular furniture unit 1000 to the modular furniture unit 3000. The abutment surface 1084 of head portion 1082 also abuts the planar end surfaces 1060 and substantially covers the recess 1068 to further prevent the tabs 1030, 1042 from being dislodged from the recesses 1068. It will be appreciated that each of the end caps 1080 are connected in a similar manner.

Figure 35:
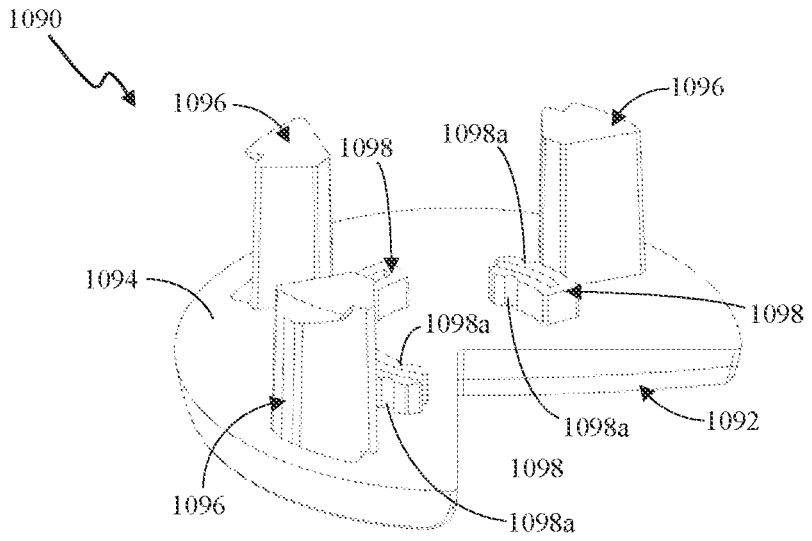
FIG. 35 is a rear perspective view of another embodiment of an end cap.
Figure 36:
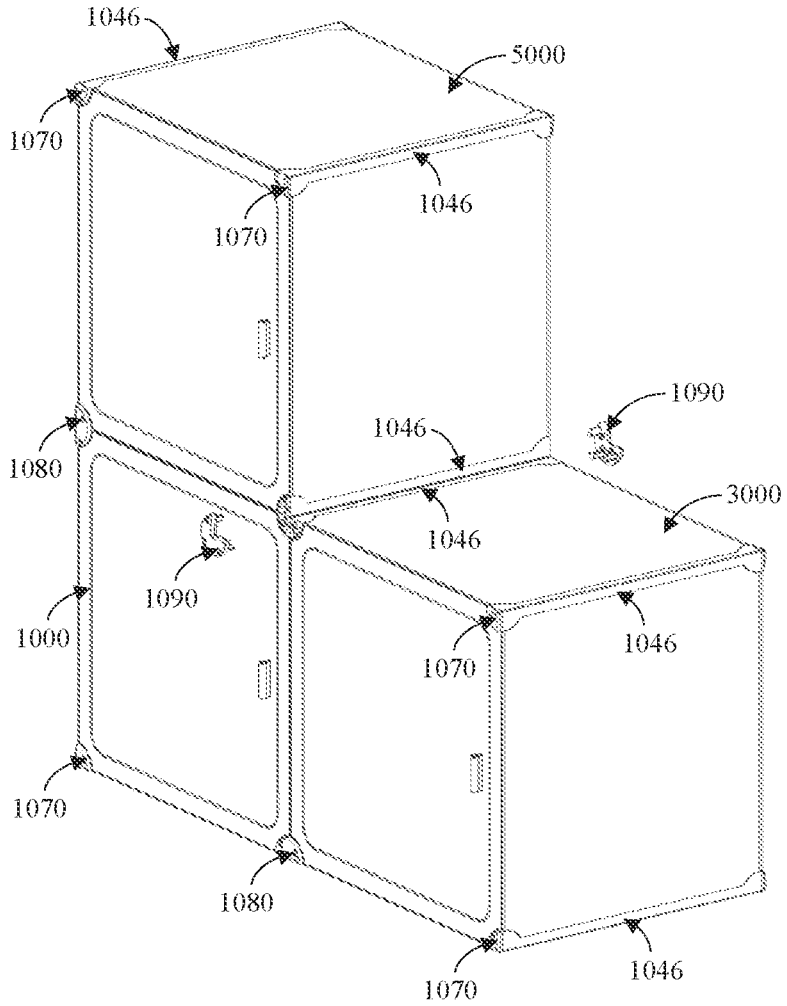
FIG. 36 is a front perspective view of a modular furniture system with three modular furniture units being connected together in a stepped-configuration.

FIG. 35 shows another embodiment of an end cap 1090. The end cap 1090 comprises a head portion 1092 with a planar abutment surface 1094, and three connecting pin portions 1096 and three locking pin portions 1098 that extend from the head portion 1092. Each of the locking pin portions 1098 defines two opposed slots 1098*a*. The end cap 1090 is used for connecting three modular furniture units together. For example, as shown in FIG. 36, two end caps 1090 are used to connect the modular furniture unit 1000, the modular furniture unit 3000 and a modular furniture unit 5000 together in a stepped-configuration. The modular furniture unit 5000 is substantially similar to the modular furniture unit 1000 and like features have been indicated with like reference numerals. Each of the end caps 1090 is connected in a similar manner to that described above with respect to the end caps 1070, 1080, in which the connecting pin portions 1096 and the locking pin portions 1098 are received in the respective first and second apertures 1062, 1064 of the wall connectors 1046 of the modular furniture units 1000, 3000, 5000, and the end cap 1090 is rotated in a clockwise direction relative to the wall connectors 1046 such that the connecting pin portions 1096 engage with the respective end portions 1050, 1052 in a bayonet arrangement and the flange portions 1064*a* are received in the slots 1098*a* to form a snap lock connection therewith, thereby connecting the modular furniture units 1000, 3000, 5000 together. The abutment surface 1094 of head portion 1092 also abuts the planar end surfaces 1060 and substantially covers the recesses 1068 to further prevent the tabs 1030, 1042 from being dislodged from the recesses 1068. It will be appreciated that each of the end caps 1090 are connected in a similar manner. Additionally, a series of end caps 1080 are used to further secure the modular furniture units 100, 300, 500 together.

Figure 37:
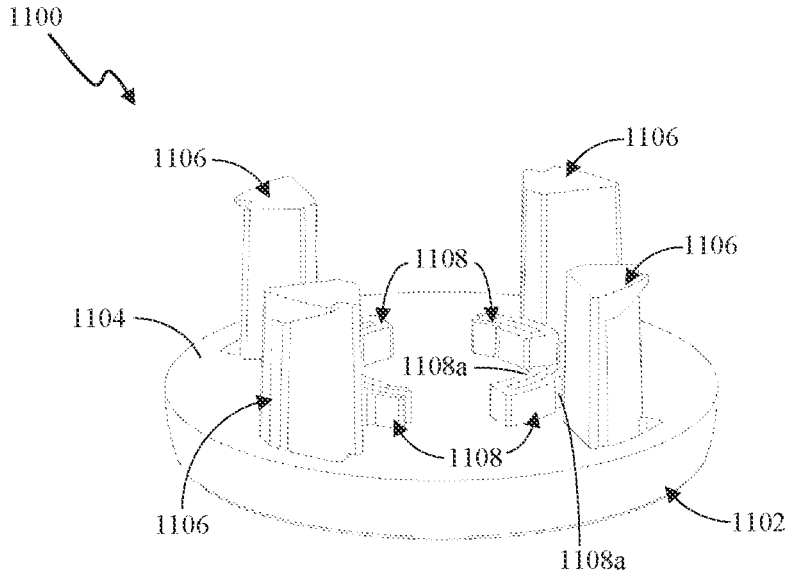
FIG. 37 is a rear perspective view of another embodiment of an end cap.
Figure 38:
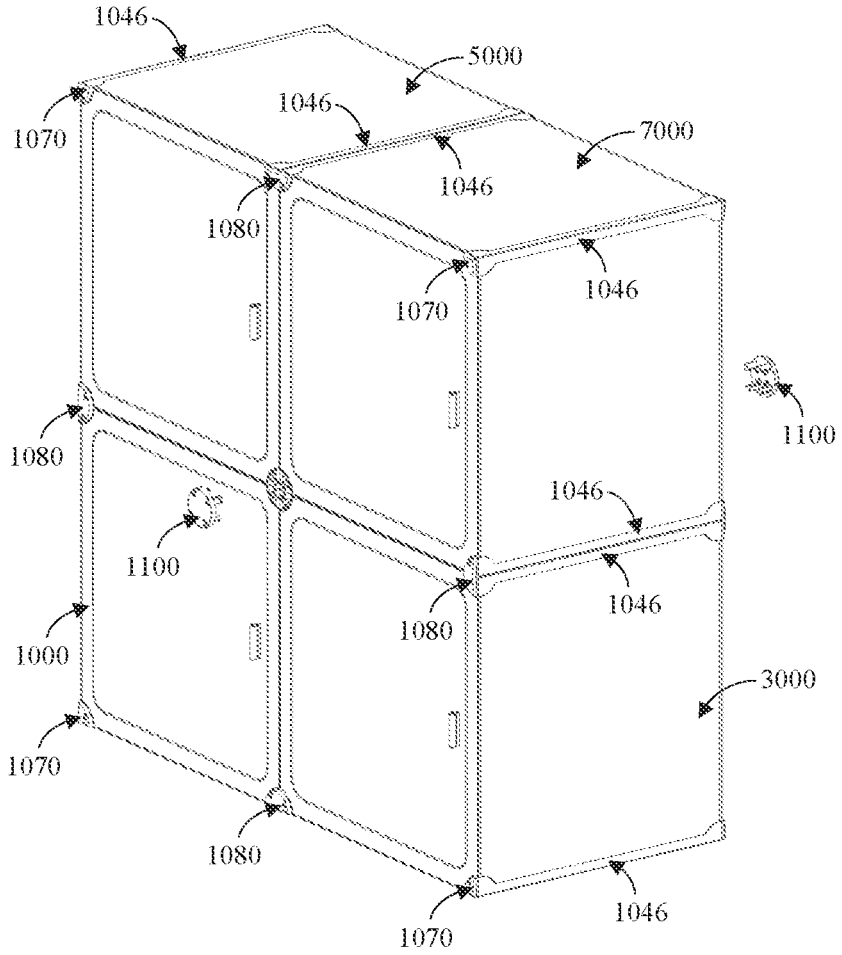
FIG. 38 is a front perspective view of a modular furniture system with four modular furniture units being connected together.

FIG. 37 shows another embodiment of an end cap 1100. The end cap 1100 comprises a head portion 1102 with a planar abutment surface 1104, and four connecting pin portions 1106 and four locking pin portions 1108 that extend from the head portion 1102. Two of the locking pins 1108 each defines two opposed slots 1108*a*. The end cap 1100 is used for connecting four modular furniture units together. For example, as shown in FIG. 38, two end caps 1100 are used to connect the modular furniture unit 1000, the modular furniture unit 3000, the modular furniture unit 5000, and a modular furniture unit 7000 together. The modular furniture unit 7000 is substantially similar to the modular furniture unit 1000 and like features have been indicated with like reference numerals. Each of the end caps 1100 is connected in a similar manner to that described above with respect to the end caps 1070, 1080, 1090 in which the connecting pin portions 1106 and the locking pin portions 1108 are received in the respective first and second apertures 1062, 1064 of the wall connectors 1046 of the modular furniture units 1000, 3000, 5000, 7000 and the end cap 1100 is rotated in a clockwise direction relative to the wall connectors 1046 such that the connecting pin portions 1106 engage the respective end portions 1050, 1052 in a bayonet arrangement and the flange portions 1064*a* are received in the slots 1108*a* to form a snap lock connection therewith, thereby connecting the modular furniture units 1000, 3000, 5000, 7000 together. The abutment surface 1104 of the head portion 1102 also abuts the planar end surfaces 1060 and substantially covers the recesses 1068 to further prevent the tabs 1030, 1042 from being dislodged from the recesses 1068. It will be appreciated that each of the end caps 1100 are connected in a similar manner. Additionally, a series of end caps 1080 are used to further secure the modular furniture units 1000, 3000, 5000, 7000 together.

Figure 39:
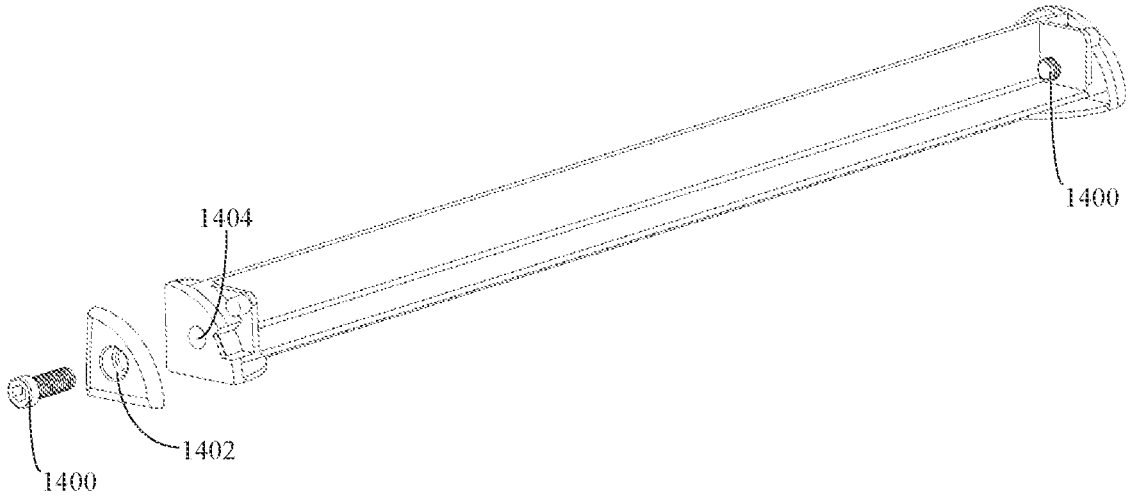
FIG. 39 is a front perspective view of a further embodiment of an end cap being connected to a further embodiment of a wall connector.
Figure 40:
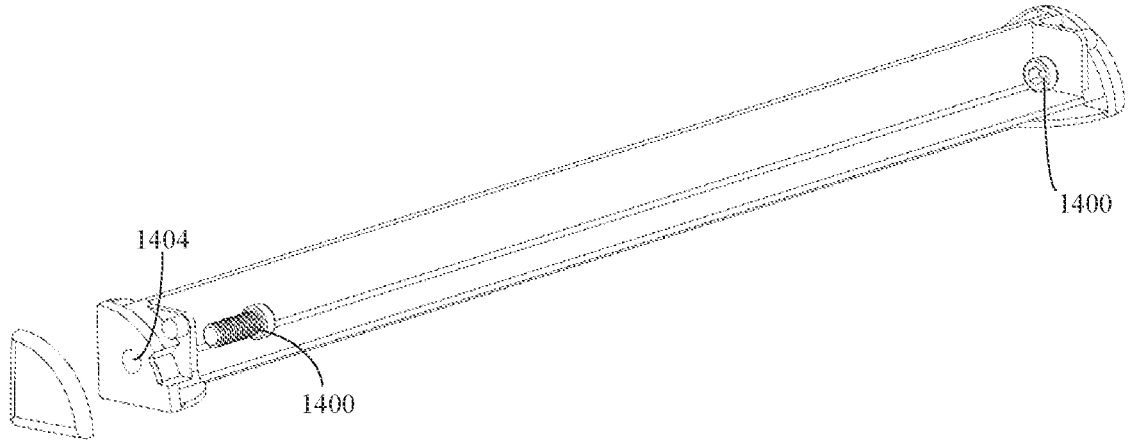
FIG. 40 is a front perspective view of a further embodiment of an end cap being connected to a further embodiment of a wall connector.

In alternative embodiments, the modular furniture system may comprise a plurality of end caps that are each connected to the end portion of a wall connector via a fastener 1400. For example, the fastener 1400 may be in the form of a bolt 1400 that extends through an aperture 1402 in the end cap and an aperture 1404 in the end portion of the wall connector (see FIG. 39), thereby fixedly attaching the end cap to the wall connector. In another example, the bolt 1400 may extend through the aperture 1404 in the end portion of the wall connector and terminate in an aperture (not shown) in the end cap (see FIG. 40).

The embodiments described above have numerous advantages. They allow a quick and relatively simple construction of one or more modular furniture units without requiring additional hardware, tooling, and detailed instructions. Further, some of the end caps can securely connect multiple modular furniture units together in a wide variety of different configurations. Moreover, the modular furniture system can be flat-packed and delivered in a small box or multiple small boxes, so that the modular furniture system can be delivered without the use of oversized delivery cartons.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A modular furniture system, comprising:

a plurality of side walls, each of the side walls having opposed edge portions;

a plurality of end walls, each of the end walls having four corner portions; and a wall connector, the wall connector including a rail extending between a first end portion and a second end portion, the rail defining a first channel configured to fittingly receive an edge portion of a first of the side walls and a second channel configured to fittingly receive an edge portion of a second of the side walls such that the second side wall is orthogonal to the first side wall;

wherein each of the first and second end portions is configured to engage a corner portion of one of the end walls for attachment thereto; and wherein each of the first and second end portions comprises a ridge locating surface for abutment with a corner end surface of the corner portion, the corner end surface including a tab extending therefrom, the ridge locating surface having a recess to receive the tab extending from the corner end surface to form a snap lock connection therewith.

2. The modular furniture system of claim 1, wherein each of the first and second end portions comprises a planar locating surface for abutment with an interior surface of the corner portion, and a planar end surface with a first aperture therein for receiving a connecting pin portion of an end cap to form a bayonet connection therewith.

3. The modular furniture system of claim 2, wherein each of the planar end surfaces further comprises a second aperture for receiving a locking pin portion of the end cap to form a snap lock connection therewith.

4. The modular furniture system of claim 2, wherein each of the first and second end portions further comprises a protrusion extending from the planar locating surface, the protrusion being configured to be fittingly received in a recess on the interior surface of the corner portion.

5. The modular furniture system of claim 1, further comprising:

a plurality of end caps; and a plurality of wall connectors;

wherein each of the opposed edge portions of the side walls is received within one of the channels of the wall connectors;

wherein each of the corner portions of the end walls is engaged with one of the end portions of the wall connectors; and wherein each of the end caps is engaged with at least one of the end portions of the wall connectors to form one or more modular furniture units defining respective internal chambers.

6. The modular furniture system of claim 5, wherein at least one of the end caps comprises a head portion and a connecting pin portion extending from the head portion, and wherein the connecting pin portion is received in an aperture of a respective end portion to form a bayonet connection therewith.

7. The modular furniture system of claim 6, wherein said at least one of the end caps further comprises a locking pin portion extending from the head portion, and wherein the locking pin portion is received in a further aperture of the respective end portion to form a snap lock connection therewith.

8. The modular furniture system of claim 5, wherein at least one of the end caps engages a respective end portion of one of the wall connectors of a first of the modular furniture units, and a respective end portion of one of the wall connectors of a second of the modular furniture units.

9. The modular furniture system of claim 8, wherein at least one of the end caps comprises a head portion and two connecting pin portions extending from the head portion, and wherein a first of the connecting pin portions is received in an aperture of the respective end portion of one of the wall connectors of the first of the modular furniture units to form a bayonet connection therewith, and a second of the connecting pin portions is received in an aperture of the respective end portion of one of the wall connectors of the second of the modular furniture units to form a bayonet connection therewith such that the first of the modular furniture units is connected to the second of the modular furniture units.

10. The modular furniture system of claim 9, wherein said at least one of the end caps further comprises two locking pin portions extending from the head portion, and wherein a first of the locking pin portions is received in a further aperture of the respective end portion of one of the wall connectors of the first of the modular furniture units to form a snap lock connection therewith, and a second of the locking pin portions is received in a further aperture of the respective end portion of one of the wall connectors of the second of the modular furniture units to form a snap lock connection therewith.

11. The modular furniture system of claim 5, wherein at least one of the end caps engages a respective end portion of one of the wall connectors of a first of the modular furniture units, a respective end portion of one of the wall connectors of a second of the modular furniture units, and a respective end portion of one of the wall connectors of a third of the modular furniture units.

12. The modular furniture system of claim 11, wherein at least one of the end caps comprises a head portion and three connecting pin portions extending from the head portion, and wherein a first of the connecting pin portions is received in an aperture of the respective end portion of one of the wall connectors of the first of the modular furniture units to form a bayonet connection therewith, a second of the connecting pin portions is received in an aperture of the respective end portion of one of the wall connectors of the second of the modular furniture units to form a bayonet connection therewith, and a third of the connecting pin portions is received in an aperture of the respective end portion of one of the wall connectors of the third of the modular furniture units to form a bayonet connection therewith such that the first, second and third of the modular furniture units are connected together.

13. The modular furniture system of claim 12, wherein said at least one of the end caps further comprises three locking pin portions extending from the head portion, and wherein a first of the locking pin portions is received in a further aperture of the respective end portion of one of the wall connectors of the first of the modular furniture units to form a snap lock connection therewith, a second of the locking pin portions is received in a further aperture of the respective end portion of one of the wall connectors of the second of the modular furniture units to form a snap lock connection therewith, and a third of the locking pin portions is received in a further aperture of the respective end portion of one of the wall connectors of the third of the modular furniture units to form a snap lock connection therewith.

14. The modular furniture system of claim 5, wherein at least one of the end caps engages a respective end portion of one of the wall connectors of a first of the modular furniture units, a respective end portion of one of the wall connectors of a second of the modular furniture units, a respective end portion of one of the wall connectors of a third of the modular furniture units, and a respective end portion of one of the wall connectors of a fourth of the modular furniture units.

15. The modular furniture system of claim 14, wherein at least one of the end caps comprises a head portion and four connecting pin portions extending from the head portion, and wherein a first of the connecting pin portions is received in an aperture of the respective end portion of one of the wall connectors of the first of the modular furniture units to form a bayonet connection therewith, a second of the connecting pin portions is received in an aperture of the respective end portion of one of the wall connectors of the second of the modular furniture units to form a bayonet connection therewith, a third of the connecting pin portions is received in an aperture of the respective end portion of one of the wall connectors of the third of the modular furniture units to form a bayonet connection therewith, and a fourth of the connecting pin portions is received in an aperture of the respective end portion of one of the wall connectors of the fourth of the modular furniture units to form a bayonet connection therewith such that the first, second, third and fourth of the modular furniture units are connected together.

16. The modular furniture system of claim 15, wherein said at least one of the end caps further comprises four locking pin portions extending from the head portion, and wherein a first of the locking pin portions is received in a further aperture of the respective end portion of one of the wall connectors of the first of the modular furniture units to form a snap lock connection therewith, a second of the locking pin portions is received in a further aperture of the respective end portion of one of the wall connectors of the second of the modular furniture units to form a snap lock connection therewith, a third of the locking pin portions is received in a further aperture of the respective end portion of one of the wall connectors of the third of the modular furniture units to form a snap lock connection therewith, and a fourth of the locking pin portions is received in a further aperture of the respective end portion of one of the wall connectors of the fourth of the modular furniture units to form a snap lock connection therewith.

17. The modular furniture system of claim 5, further comprising a plurality of fasteners, wherein at least one of the end caps comprises an aperture, and wherein one of the fasteners is received in the aperture of said at least one of the end caps and in an aperture of a respective end portion.

18. The modular furniture system of claim 5, wherein each of the modular furniture units defines a box with an internal chamber.

19. The modular furniture system of claim 5, wherein at least one of the end walls comprises a frame defining the corner portions and a door hingedly connected to the frame.

* * * * *